US012410003B2

(12) United States Patent
Sedory et al.

(10) Patent No.: US 12,410,003 B2
(45) Date of Patent: Sep. 9, 2025

(54) REFUSE CONTAINER HAVING MODULAR SIDE WALLS

(71) Applicant: Wastequip, LLC, Charlotte, NC (US)

(72) Inventors: Samuel Sedory, Charlotte, NC (US); Nicholas Franiak, Waxhaw, NC (US); Joshua Stidham, Mooresville, NC (US); Matthew Del Valle, Charlotte, NC (US)

(73) Assignee: Wastequip, LLC, Charlotte, NC (US)

( * ) Notice: Subject to any disclaimer, the term of this patent is extended or adjusted under 35 U.S.C. 154(b) by 0 days.

(21) Appl. No.: 18/210,373

(22) Filed: Jun. 15, 2023

(65) Prior Publication Data

US 2023/0406612 A1 Dec. 21, 2023

Related U.S. Application Data

(63) Continuation-in-part of application No. 17/844,688, filed on Jun. 20, 2022, now Pat. No. 12,098,024.

(51) Int. Cl.

| | |
|---|---|
| ***B65D 88/00*** | (2006.01) |
| ***B65D 88/12*** | (2006.01) |
| ***B65D 88/52*** | (2006.01) |

(52) U.S. Cl.

CPC ..... *B65D 88/005* (2013.01); *B65D 88/123* (2013.01); *B65D 88/528* (2013.01)

(58) Field of Classification Search

CPC .... B65D 90/023; B65D 90/08; B65D 88/005; B65D 88/123; E04C 2/08; E04C 2/384

USPC ..... 52/588.1, 79.5, 79.9; 296/186, 1, 205; 220/4.28, 4.33

See application file for complete search history.

(56) References Cited

U.S. PATENT DOCUMENTS

| | | | | |
|---|---|---|---|---|
| 2,019,707 | A | 11/1935 | Jenkins | |
| 3,631,647 | A * | 1/1972 | Merkin | E04B 2/72 52/645 |
| 3,692,349 | A * | 9/1972 | Ehrlich | B62D 33/04 296/186.1 |
| 3,803,738 | A | 4/1974 | Weiss | |
| 3,817,569 | A * | 6/1974 | Ehrlich | B60J 5/108 296/186.1 |
| 4,566,243 | A * | 1/1986 | Dahlin | E04F 15/02161 52/669 |

(Continued)

OTHER PUBLICATIONS

Notice of Allowance for U.S. Appl. No. 17/844,688 dated May 22, 2024.

*Primary Examiner* — Mollie Impink

(74) *Attorney, Agent, or Firm* — Nelson Mullins Riley & Scarborough LLP

(57) ABSTRACT

A container including first, second, and third side walls and an open end; a bottom wall coupled with the first, second, and third side walls; and a door pivotably coupled to the container and movable between a first position at which the door is spaced apart from the at least one open end and a second position at which the door closes the at least one open end. The container defines an interior volume of at least ten (10) cubic yards. At least one of the first, second, and third side walls includes a plurality of rectangular side panels releasably fastened together by mechanical fasteners. Each of the plurality of side panels defines a longitudinal axis. The longitudinal axes of each of the plurality of rectangular side panels are parallel with the bottom wall.

19 Claims, 24 Drawing Sheets

(56) References Cited

U.S. PATENT DOCUMENTS

| | | | | | |
|---|---|---|---|---|---|
| 4,603,532 | A * | 8/1986 | Watson | E04B 5/10 | 52/262 |
| 4,810,027 | A | 3/1989 | Ehrlich | | |
| 4,840,127 | A | 6/1989 | Tomaka | | |
| 4,904,017 | A | 2/1990 | Ehrlich | | |
| 4,913,301 | A | 4/1990 | Pickler | | |
| 4,940,279 | A * | 7/1990 | Abott | B32B 7/12 | 52/309.8 |
| 5,088,875 | A | 2/1992 | Galbreath et al. | | |
| 5,154,302 | A * | 10/1992 | Alcorn | B65D 88/123 | 220/4.16 |
| 5,348,176 | A * | 9/1994 | Yurgevich | B65D 88/121 | 24/287 |
| 5,531,559 | A | 7/1996 | Kruzick | | |
| 5,542,807 | A | 8/1996 | Kruzick | | |
| 5,584,527 | A | 12/1996 | Sitter | | |
| 5,619,837 | A * | 4/1997 | DiSanto | E04C 2/384 | 52/630 |
| 5,876,089 | A | 3/1999 | Ehrlich | | |
| 5,884,794 | A | 3/1999 | Calhoun et al. | | |
| 5,938,274 | A | 8/1999 | Ehrlich | | |
| 5,992,117 | A * | 11/1999 | Schmidt | B62D 33/046 | 52/584.1 |
| 5,997,076 | A * | 12/1999 | Ehrlich | B62D 33/046 | 296/186.1 |
| 6,199,939 | B1 * | 3/2001 | Ehrlich | B65D 90/08 | 52/582.1 |
| 6,527,335 | B1 * | 3/2003 | Yurgevich | B62D 33/04 | 52/584.1 |
| 6,652,018 | B2 | 11/2003 | Buchholz et al. | | |
| 7,198,166 | B2 | 4/2007 | Sholinder | | |
| 7,789,256 | B2 | 9/2010 | Petzitillo, Jr. et al. | | |
| 9,067,729 | B2 | 6/2015 | Fenton | | |
| 9,446,656 | B2 | 9/2016 | Alder | | |
| 9,701,466 | B1 * | 7/2017 | Horton | B65D 88/56 | |
| 9,738,050 | B2 | 8/2017 | Lee et al. | | |
| 9,863,146 | B2 | 1/2018 | Bogh et al. | | |
| 9,896,013 | B2 | 2/2018 | Franiak et al. | | |
| 10,144,583 | B2 | 12/2018 | Monaco et al. | | |
| 10,730,568 | B2 | 8/2020 | Ehrlich | | |
| 11,370,603 | B2 | 6/2022 | Chojecki et al. | | |
| 2010/0162929 | A1 | 7/2010 | Smit | | |
| 2015/0034637 | A1 | 2/2015 | Durand et al. | | |

* cited by examiner

REFUSE CONTAINER HAVING MODULAR SIDE WALLS

PRIORITY CLAIM

This application is a continuation-in-part of U.S. application Ser. No. 17/844,688, entitled "Refuse Container Having Modular Side Walls," filed on Jun. 20, 2022, which is hereby relied upon and incorporated herein by reference for all purposes.

TECHNICAL FIELD

Embodiments of the present invention generally relate to the field of material-hauling containers. More particularly, certain embodiments of the present invention relate to improved refuse containers, including but not limited to roll-off dumpsters, having non-welded side wall assemblies. Among other things, various embodiments provide roll-off containers having one or more side walls comprising a plurality of panels that are releasably fastened together.

BACKGROUND

In the waste and materials hauling industry, a variety of containers are used to collect, transport, and/or dump waste, bulk, and liquid materials, among others. Such containers typically are carried on vehicles, such as trucks, or on trailers. The vehicle or trailer is provided with a hoist apparatus to load a container onto and unload the container from the vehicle or trailer, transport the container, and empty the container. Examples of hoist apparatuses include hook hoists, cable hoists, winches, forklifts, and container handlers. The containers loaded and carried by hoist apparatuses may be very heavy, especially when filled. Accordingly, and for example, hoist apparatuses may be rated for a container capacity of 20,000 or 30,000 lbs. Heavier duty hoist apparatuses can be rated for more than 30,000 lbs., in some cases up to 75,000 lbs. or greater.

One type of refuse container is known as a "roll-off container." Roll-off containers can be used in a variety of demanding waste applications, including scrap collection, construction and remodeling, demolition, and industrial clean-up, among others. Roll-off containers are usually designated by the volume of material they can contain, such as 10, 20, 30, or 40 cubic yards. Roll-off containers are currently available from a number of companies, such as Wastequip, LLC of Charlotte, North Carolina.

Two common types of roll-off containers are rectangular, open top roll-offs and "tub-style" roll offs. The latter style of roll-off container has smooth sides and may be stackable for transporting and storage. FIGS. 1-2 are perspective views of the former style of roll-off container, a rectangular, open top roll-off container 10. Container 10 includes a body 12 including walls 14 and a door 16 provided on hinges at one end thereof to facilitate access to the interior volume of container 10. Container 10 is made out of a suitable metal material, such as steel. Walls 14 can be fabricated from steel, and a floor plate of container 10 (not shown) can be made from 7 gauge steel, for example. Also, walls 14 are reinforced by a plurality of vertical supports 18 which extend between a top rail 20 and a bottom sill 22 of container 10. Also, container 10 typically includes at least one set of wheels 24 to allow container 10 to be rolled in place and onto and off of a truck frame via a hoist apparatus. In FIGS. 1-2, two sets of wheels 24 are provided. Container 10 also may include a pair of main rails 26 used to provide support for heavy refuse and to facilitate placement of container 10 on the truck frame.

As shown in FIG. 3, a vehicle 30 equipped with a cable hoist has a cab 32 and is configured to support a roll-off container 34 on a sub-frame 36 of the cable hoist pivotably connected with vehicle frame. A covering apparatus 38 is provided to extend and retract a cover over the top of container 34, as is well understood. Vehicle 30 is used for loading, unloading, transporting, and dumping container 34. For example, the sub-frame 36 of the cable hoist can be elevated and lowered relative to the vehicle frame using hydraulic cylinders, as is also well known. When the sub-frame 36 is elevated to an inclined position, it may serve as a ramp upon which container 34 may be pulled or slid onto and off of the hoist apparatus, for instance using a cable winch system to draw container 34 upward. Container 34 may also be dumped when the sub-frame 36 is in the inclined position. When container 34 is suitably secured on the sub-frame 36, the sub-frame 36 may be lowered into the position shown in FIG. 3 for transport. Those of skill in the art will appreciate that other types of hoist apparatuses may be used to load, unload, transport, and dump roll-off container 34, such as a vehicle equipped with a hook hoist. Additional background regarding vehicle mounted hook hoists is provided in U.S. Pat. Nos. 5,542,807; 5,531,559; and 5,088,875, the entire disclosures of which are incorporated herein by reference for all purposes.

The foregoing discussion is intended only to illustrate various aspects of the related art in the field of the invention at the time, and should not be taken as a disavowal of claim scope.

SUMMARY

Some example embodiments comprise apparatus and methods for providing a refuse container with non-welded side and/or bottom walls. In various embodiments, the refuse container may comprise a roll-off container, intermodal container, or any suitable dump body, among others. In various embodiments, a refuse container wall may comprise a plurality of formed sheets overlapped with one another and releasably fastened together (e.g., by bolts). Thus, example embodiments may improve manufacturing efficiency and speed and reduce cost by eliminating many or all welds on wall assemblies, such as with regard to cross-members, top channels, and bottom channels. Various embodiments also provide the ability to manufacture virtually any size (e.g., cubic yardage) of refuse container with standard, and minimal, components. Additionally, various embodiments allow for "spot-fixes" of refuse container walls "in the field," rather than a full wall or container replacement that would otherwise be required. A damaged wall segment can simply be swapped for a new segment and bolted into place. Embodiments of the invention also provide a roll-off container wall having comparable and/or improved properties (in terms of form and function) relative to existing welded walls.

According to one embodiment, the present invention provides a container comprising a first side wall, a second side wall opposite the first side wall, a front wall coupled with the first and second side walls, a rear wall opposite the front wall and coupled with at least one of the first and second side walls, and a bottom wall coupled with at least the first and second side walls and the front wall. The first side wall, second side wall, front wall, rear wall, and bottom wall together define an interior volume of at least ten (10)

cubic yards. At least one of the first side wall, second side wall, front wall, and rear wall comprise a top rail, a bottom rail, a first side panel releasably fastened with the top rail and the bottom rail, and a second side panel releasably fastened with the top rail, the bottom rail, and the first side panel. The first side panel comprises a first body portion and a first projection having a first flange. The first flange is spaced apart from the first body portion. The second side panel comprises a second body portion and a second projection having a second flange. The second flange spaced apart from the second body portion.

In another embodiment, the present invention provides a container comprising first, second, and third side walls and an open end. The container also comprises a bottom wall coupled with the first, second, and third side walls. Additionally, the container comprises a door pivotably coupled to the container and movable between a first position at which the door is spaced apart from the at least one open end and a second position at which the door closes the at least one open end. The container defines an interior volume of at least ten (10) cubic yards. At least one of the first, second, and third side walls comprises a plurality of vertically-extending side panels releasably fastened together. Each of the plurality of side panels defines a planar body portion and at least one projection from the planar body portion.

According to yet another embodiment, the present invention provides a container comprising vertical side walls and a horizontal bottom wall coupled with the vertical side walls. The vertical side walls and bottom wall together define an interior volume of at least ten (10) cubic yards. At least one vertical side wall comprises a plurality of side panels releasably fastened together. Each of the plurality of side panels defines an inner wall portion and an outer wall portion spaced apart from the inner wall portion. The at least one vertical side wall also comprises a top rail releasably fastened with the inner wall portion of each of the plurality of side panels and a bottom rail releasably fastened with the inner wall portion of each of the plurality of side panels. The outer wall portions of the plurality of side panels extend vertically from the top rail to the bottom rail.

In accordance with one embodiment, the present invention provides a container. The container comprises a first side wall, a second side wall opposite the first side wall, a front wall coupled with the first and second side walls, a rear wall opposite the front wall and coupled with at least one of the first and second side walls, and a bottom wall coupled with at least the first and second side walls and the front wall. The first side wall, second side wall, front wall, rear wall, and bottom wall together define an interior volume of at least ten (10) cubic yards. At least one of the first side wall, second side wall, front wall, and rear wall comprises a top rail and a plurality of side panels releasably fastened together via mechanical fasteners. Each of the plurality of side panels comprises a body portion, at least one projection, and a longitudinal axis. The longitudinal axes of each of the plurality of side panels are parallel with the top rail.

In accordance with another embodiment, the present invention provides a container. The container comprises first, second, and third side walls and an open end; a bottom wall coupled with the first, second, and third side walls; and a door pivotably coupled to the container and movable between a first position at which the door is spaced apart from the at least one open end and a second position at which the door closes the at least one open end. The container defines an interior volume of at least ten (10) cubic yards. At least one of the first, second, and third side walls comprises a plurality of rectangular side panels releasably fastened together by mechanical fasteners. Each of the plurality of side panels defines a longitudinal axis. The longitudinal axes of each of the plurality of rectangular side panels are parallel with the bottom wall.

In yet another embodiment, the present invention provides a container. The container comprises vertical side walls and a horizontal bottom wall coupled with the vertical side walls. The vertical side walls and horizontal bottom wall together define an interior volume of at least ten (10) cubic yards. At least one of the vertical side walls comprises a plurality of side panels releasably fastened together by mechanical fasteners. Each of the plurality of side panels comprises a body portion extending between opposite first and second lateral ends, an upper end, and an opposite lower end. The at least one of the vertical side walls also comprises a top rail releasably fastened together with the upper ends of at least one of the plurality of side panels by mechanical fasteners. The at least one of the vertical side walls further comprises a corner post releasably fastened together with the first lateral end of at least one of the plurality of side panels by mechanical fasteners. Each body portion of each of the plurality of side panels defines a longitudinal axis that is parallel with the top rail.

BRIEF DESCRIPTION OF THE DRAWINGS

Figure 1:
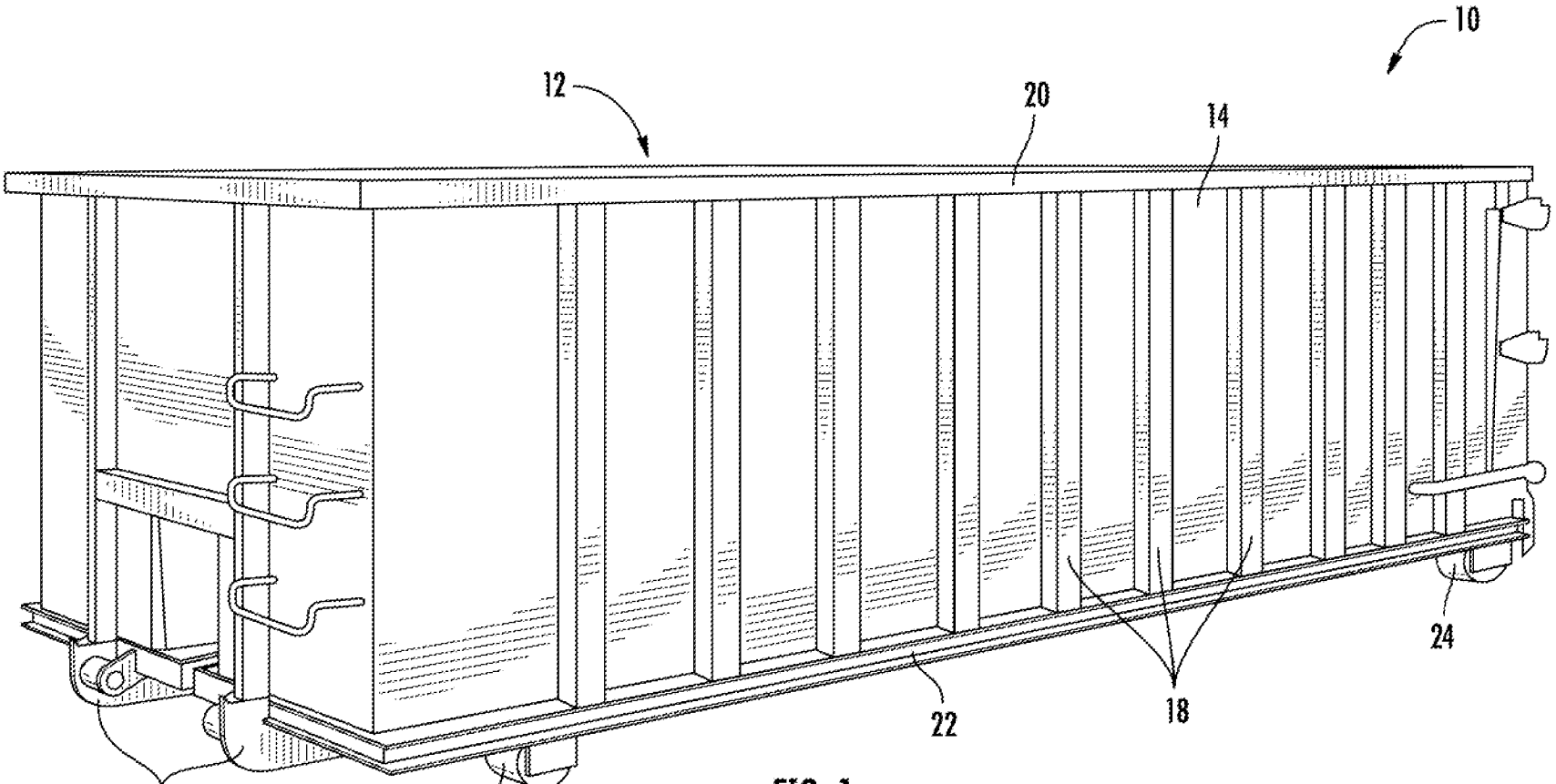
FIG. 1 PRIOR ART
Figure 2:
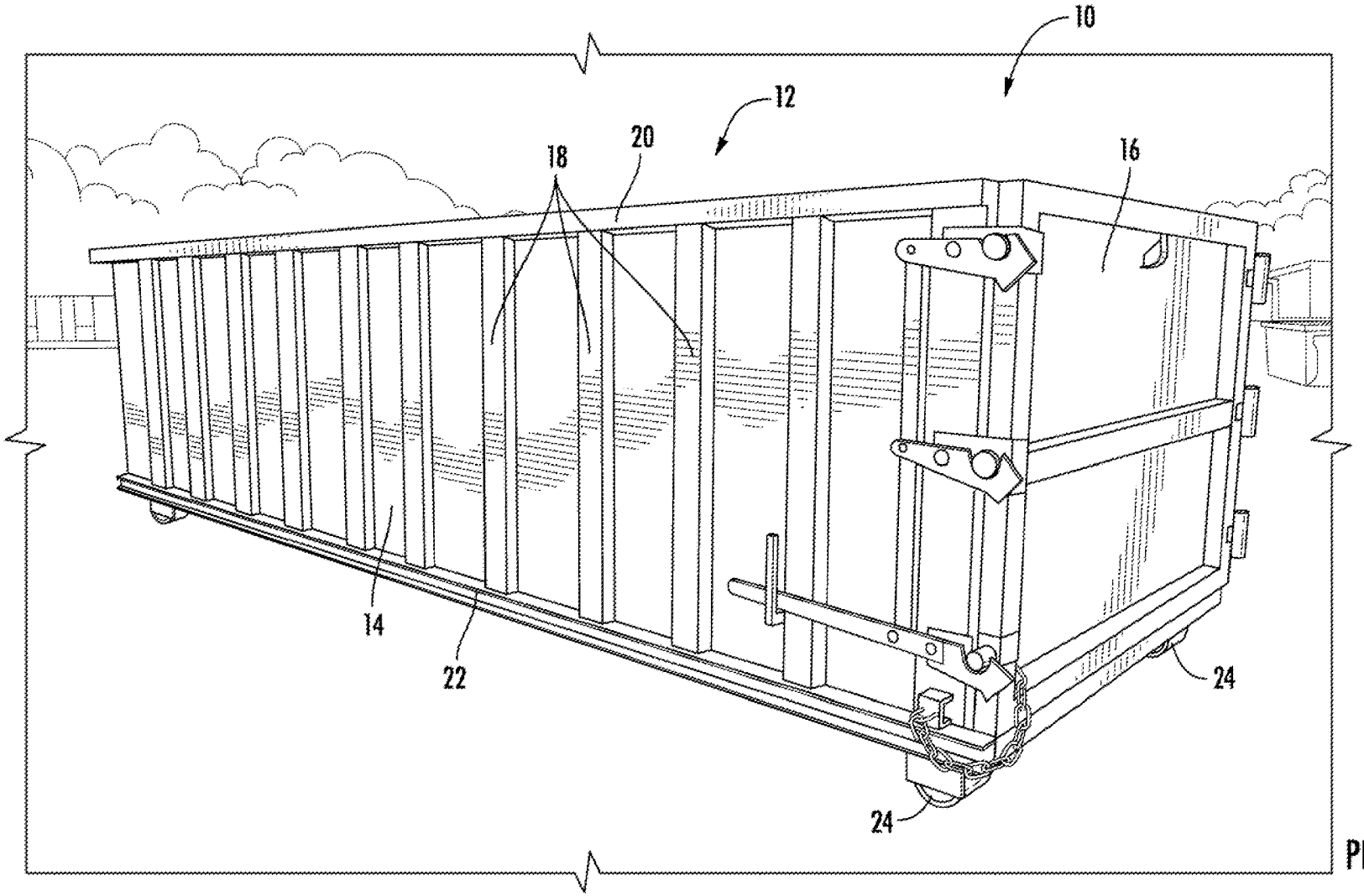
FIG. 2 PRIOR ART
Figure 3:
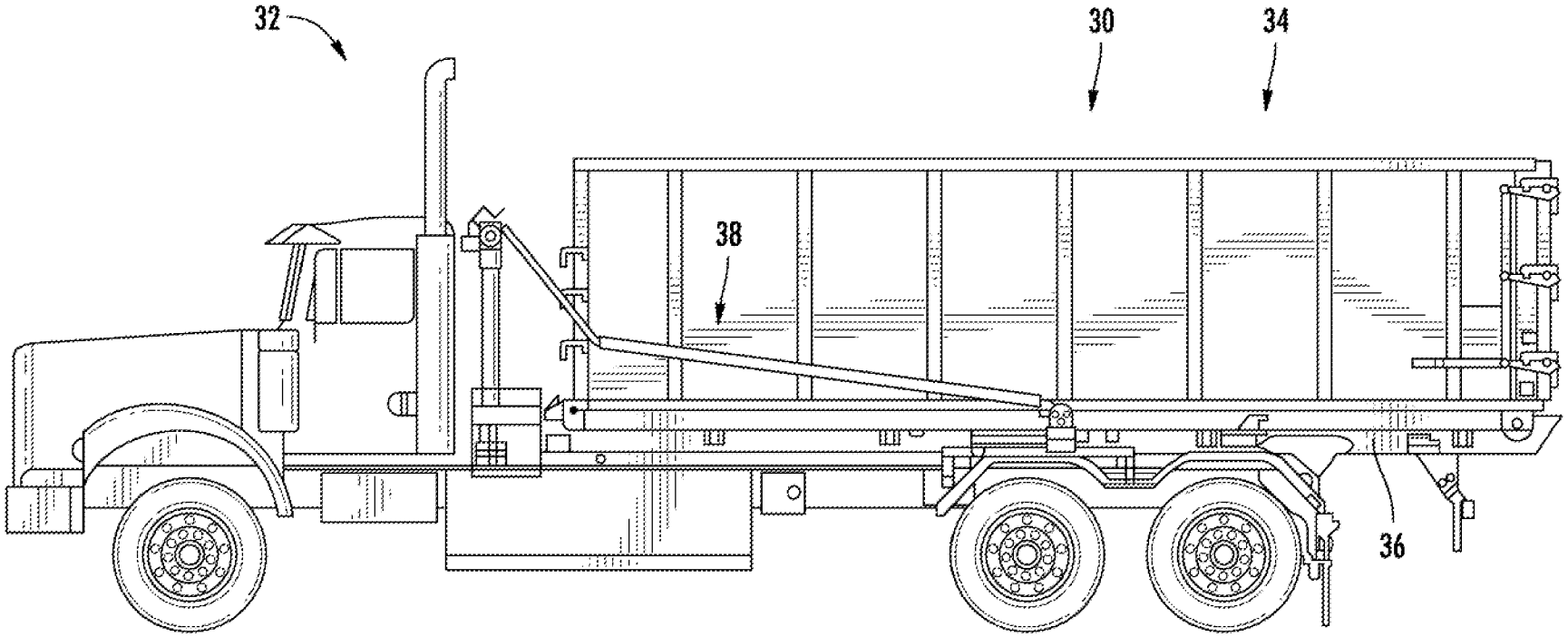
Figure 4A:
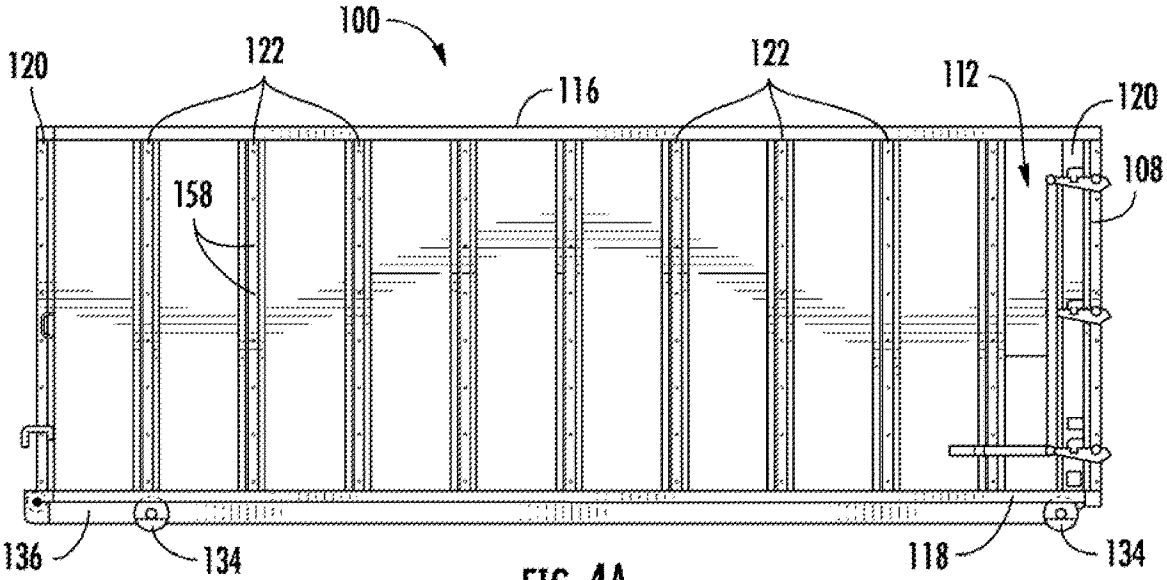
Figure 4B:
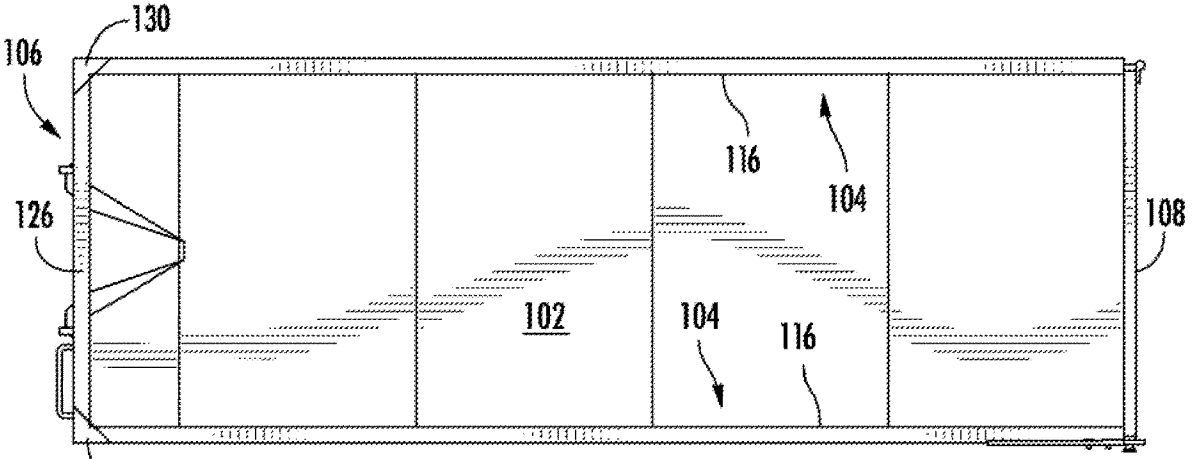
Figure 4C:
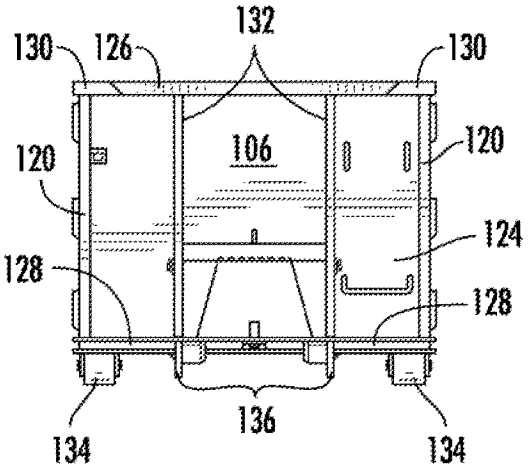
Figure 4D:
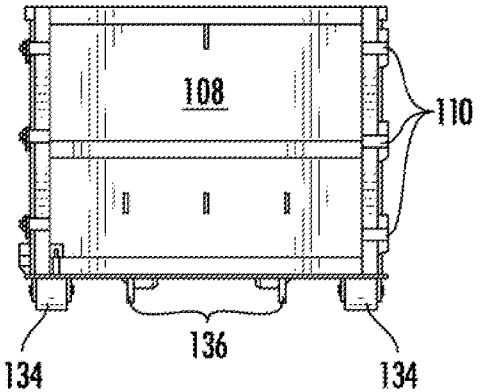
Figure 5:
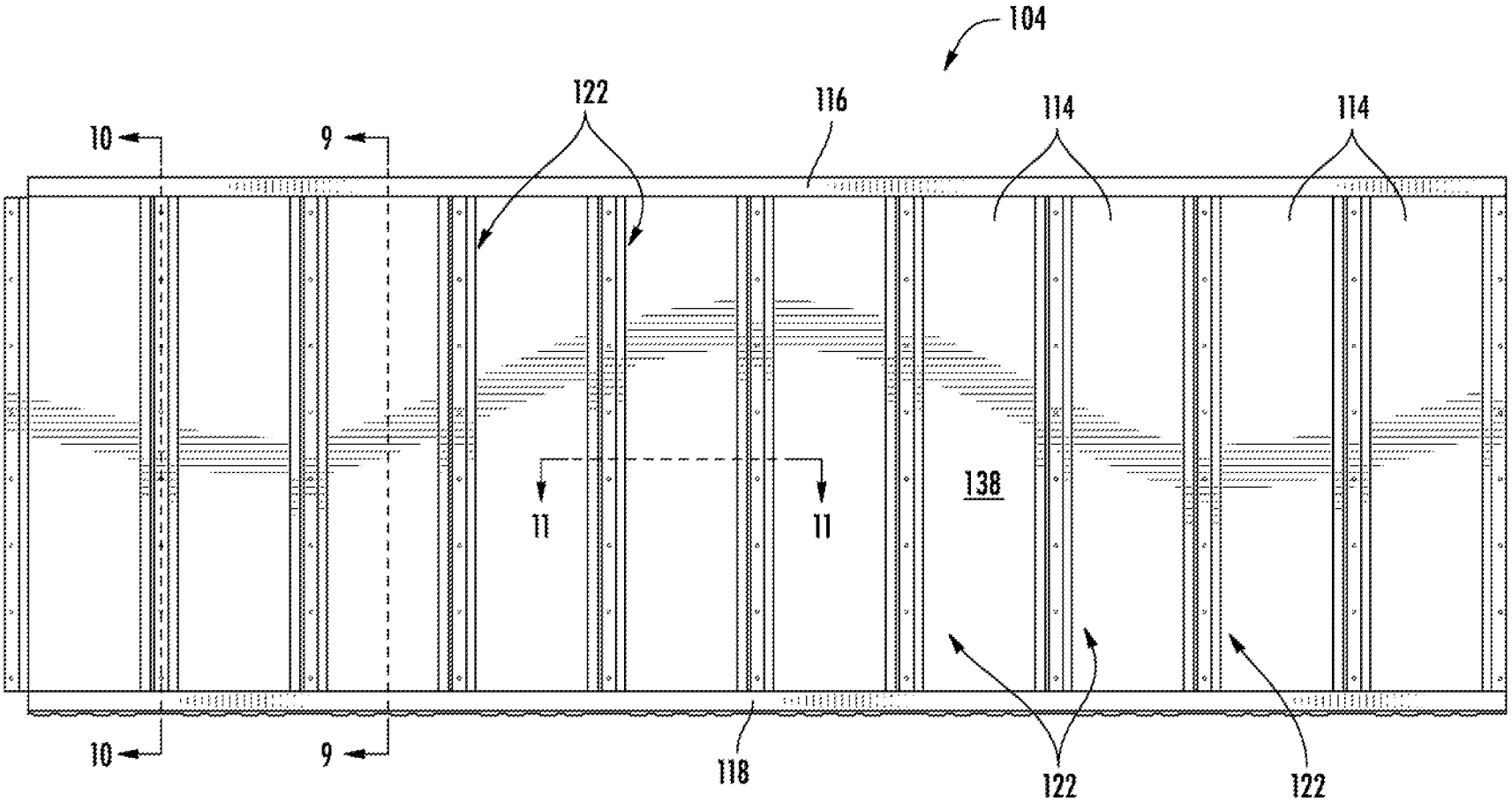
Figure 6:
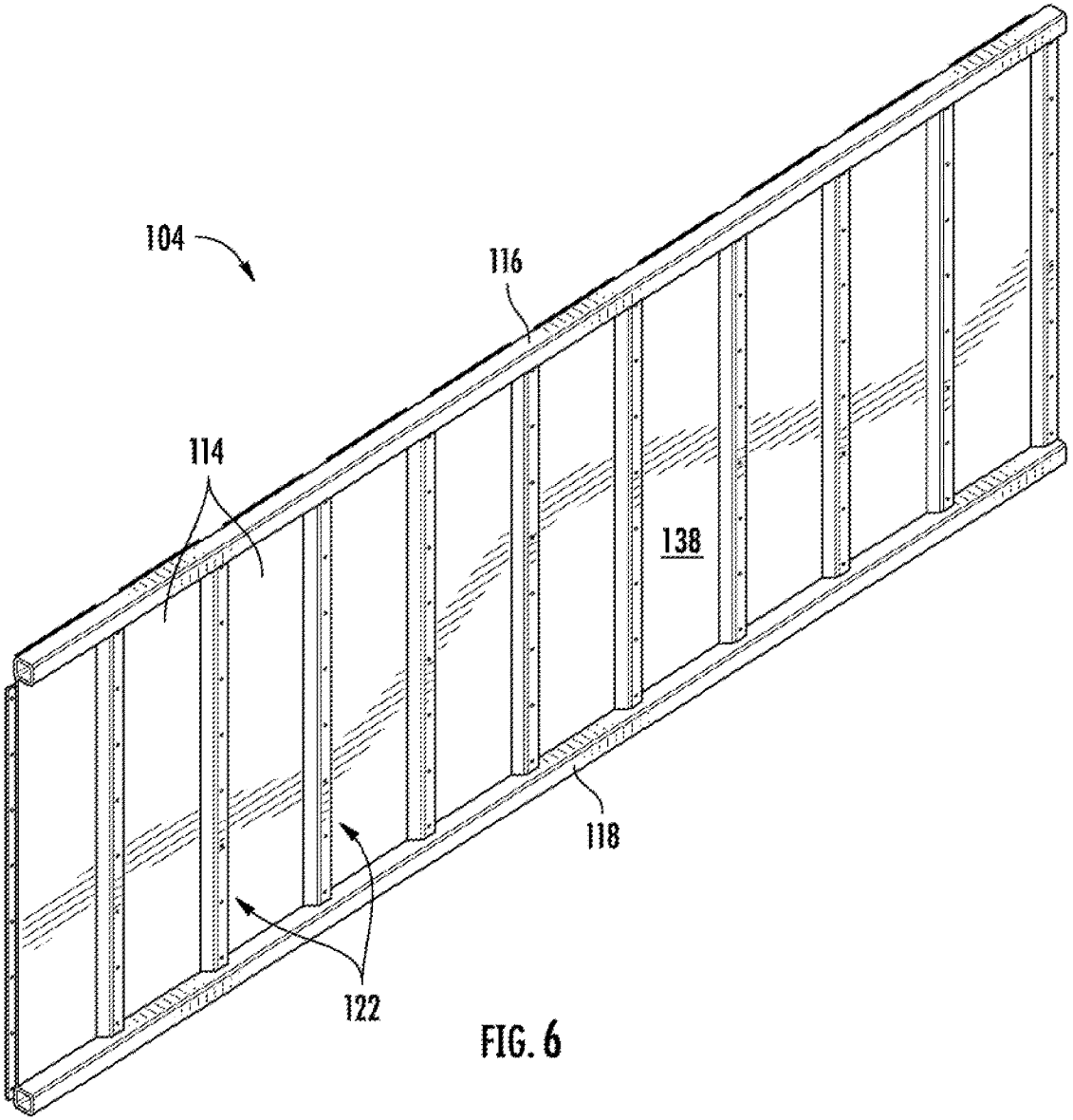
Figure 7:
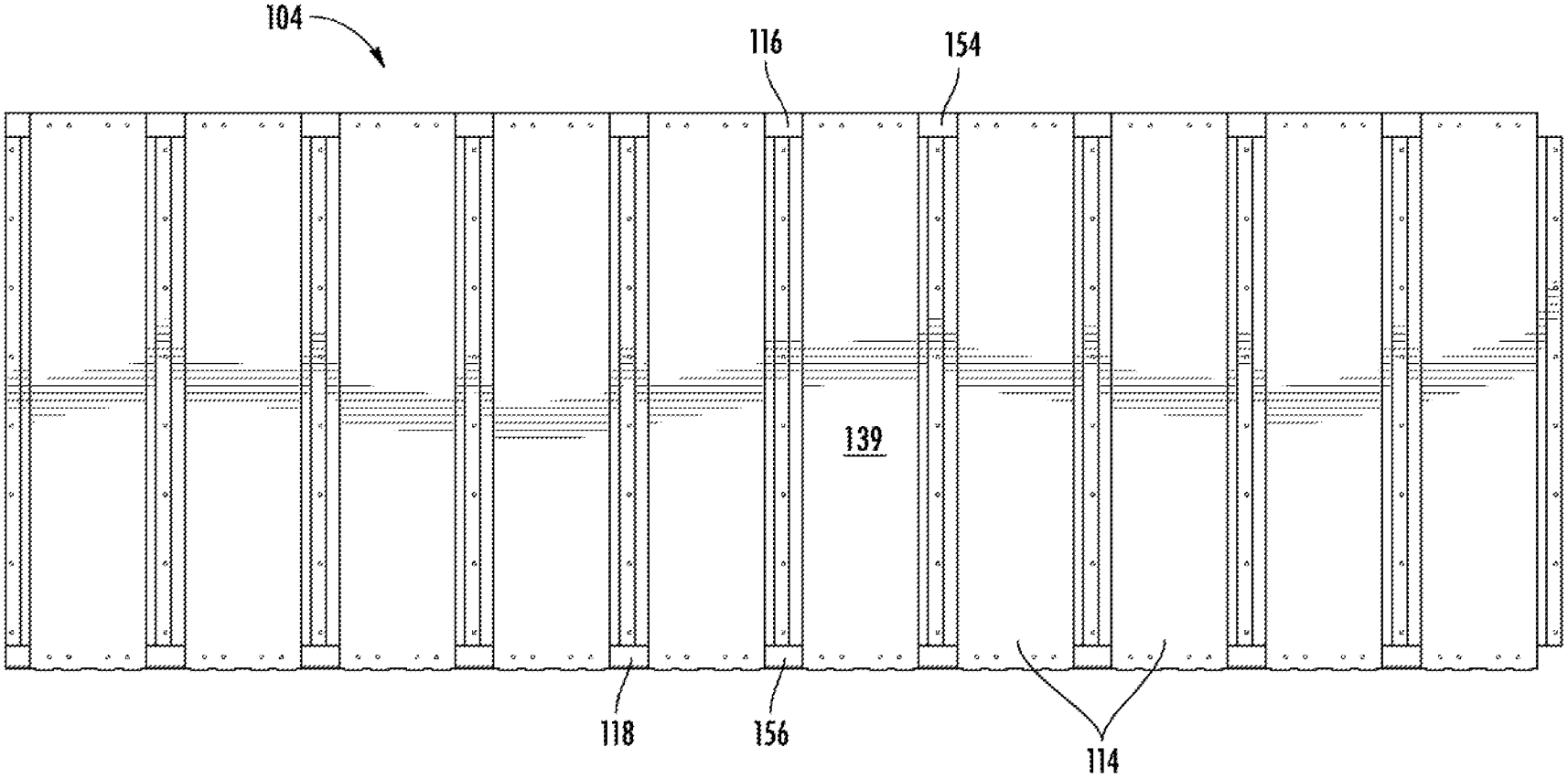
Figure 8:
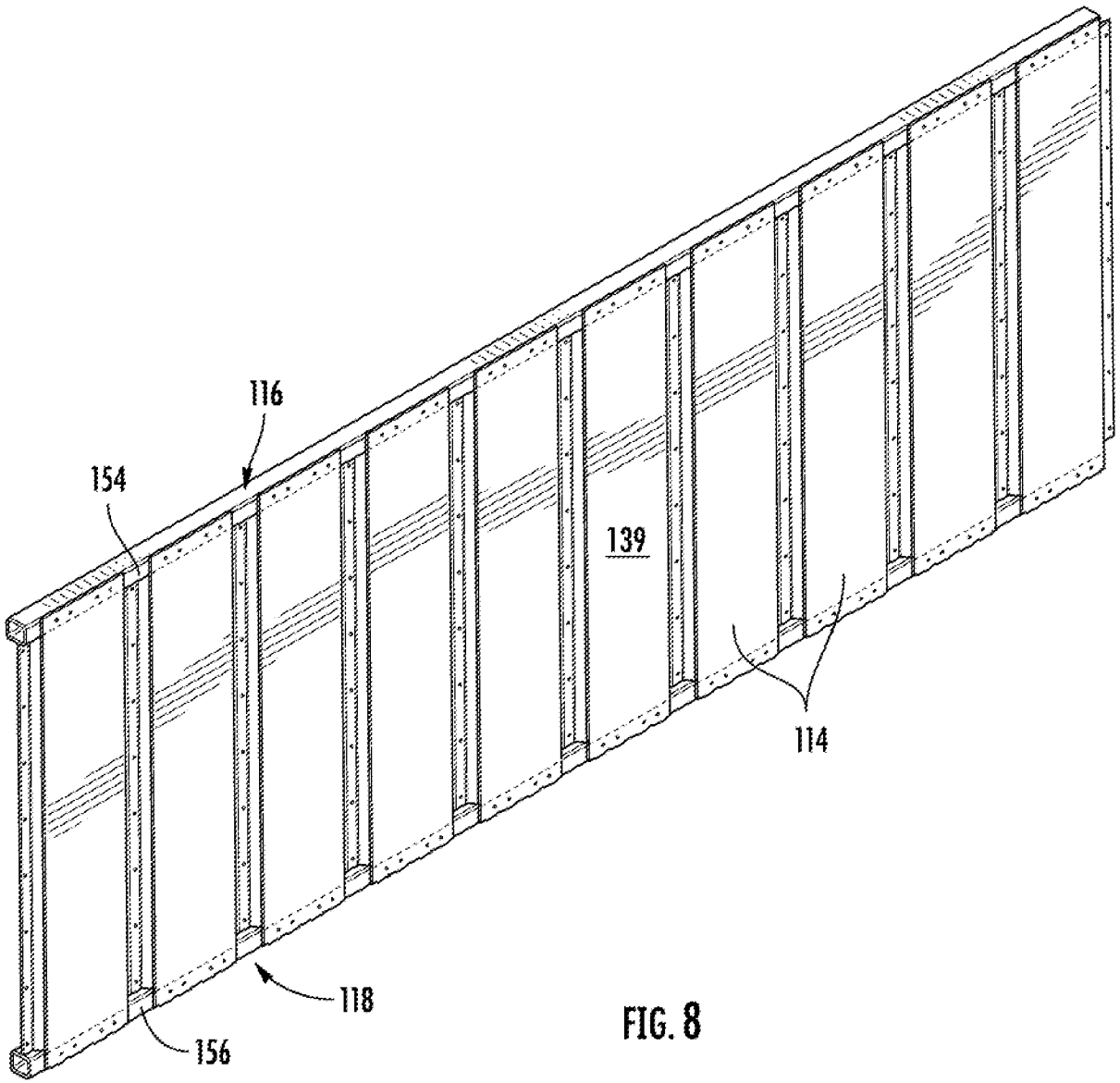
Figure 9:
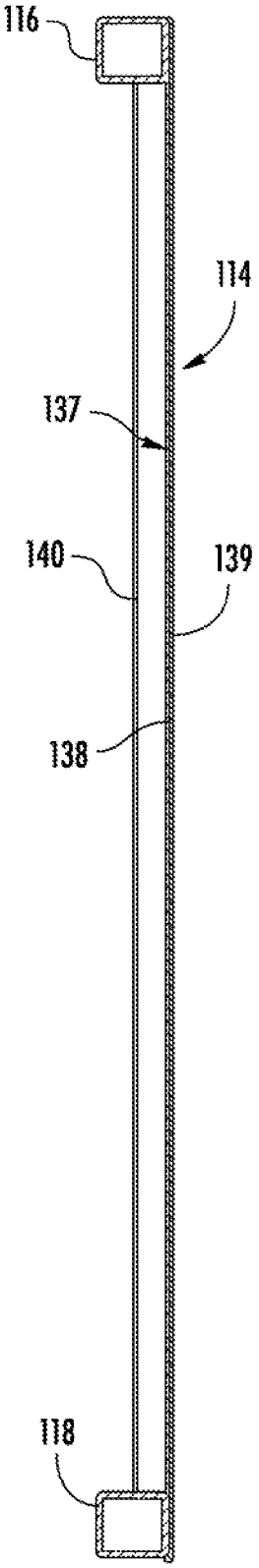
Figure 10:
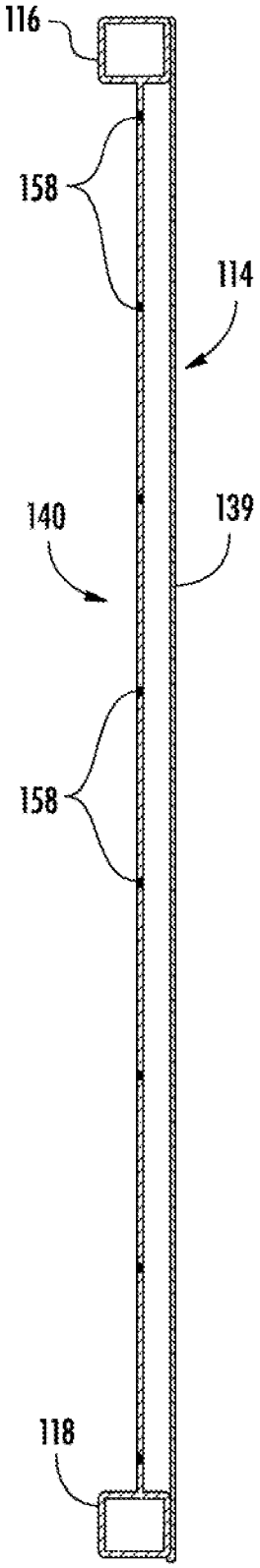
Figure 11:
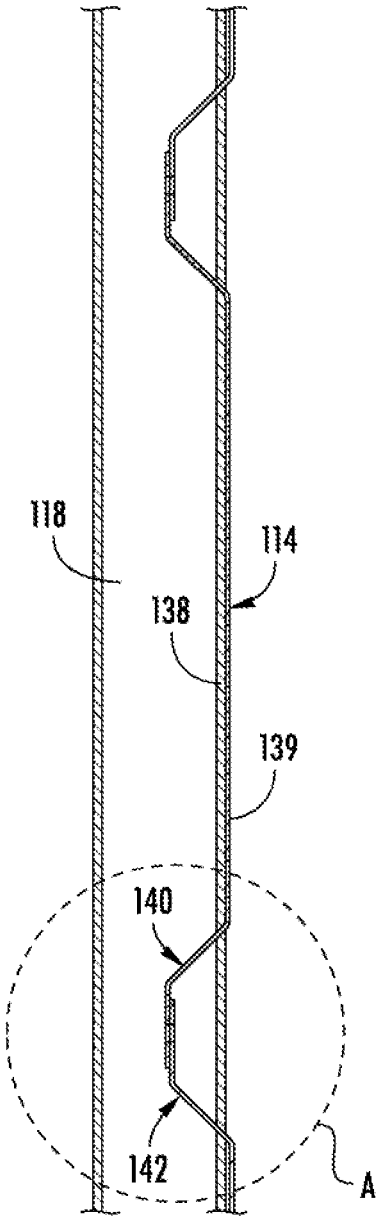
Figure 12:
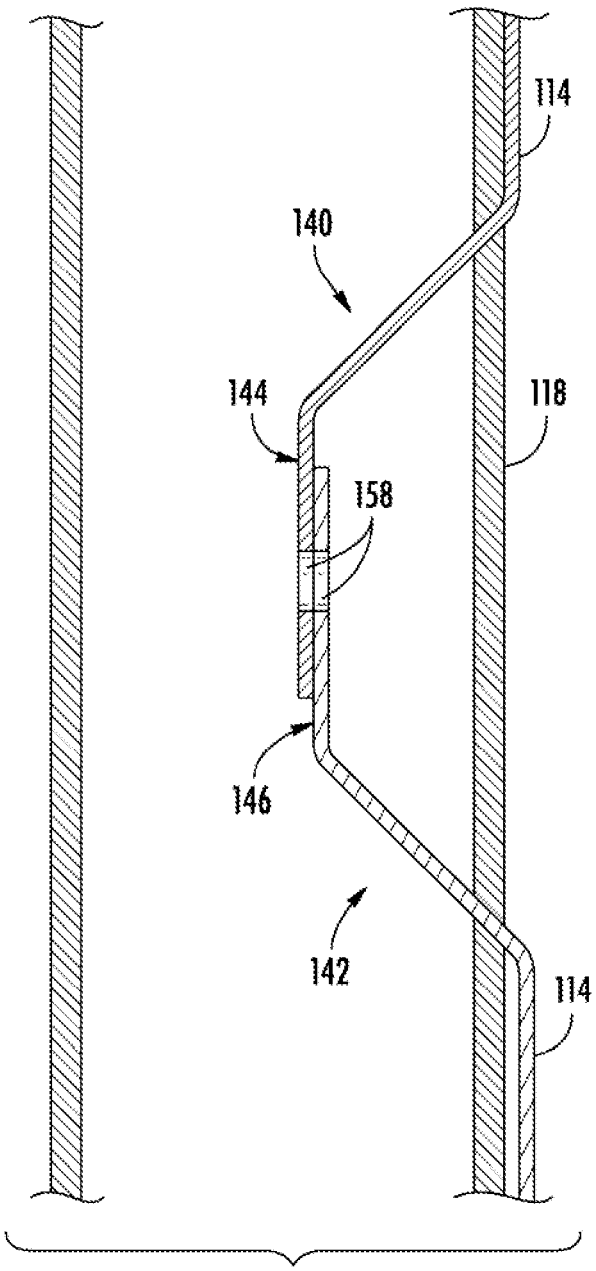
Figure 13:
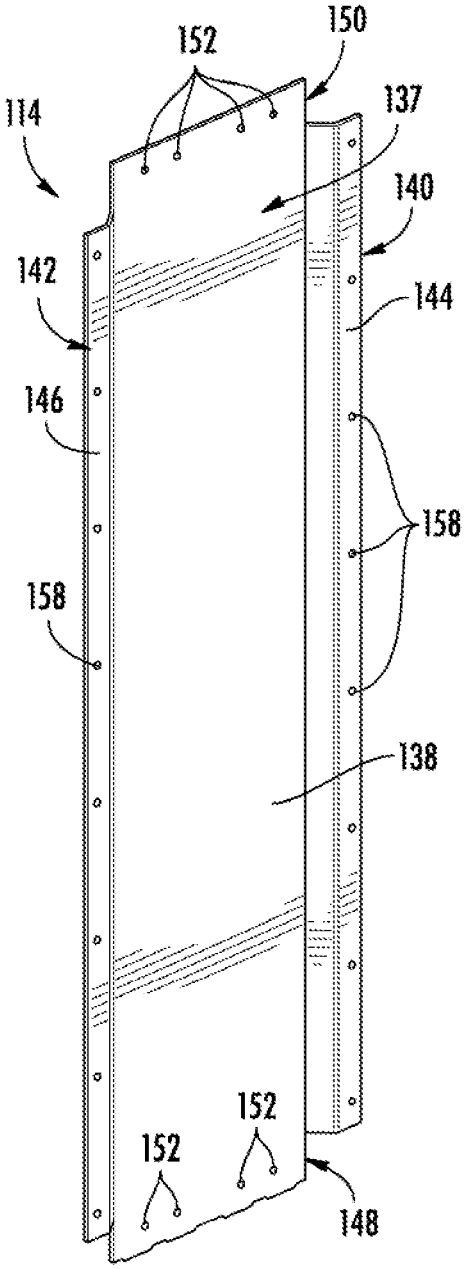
Figure 14:
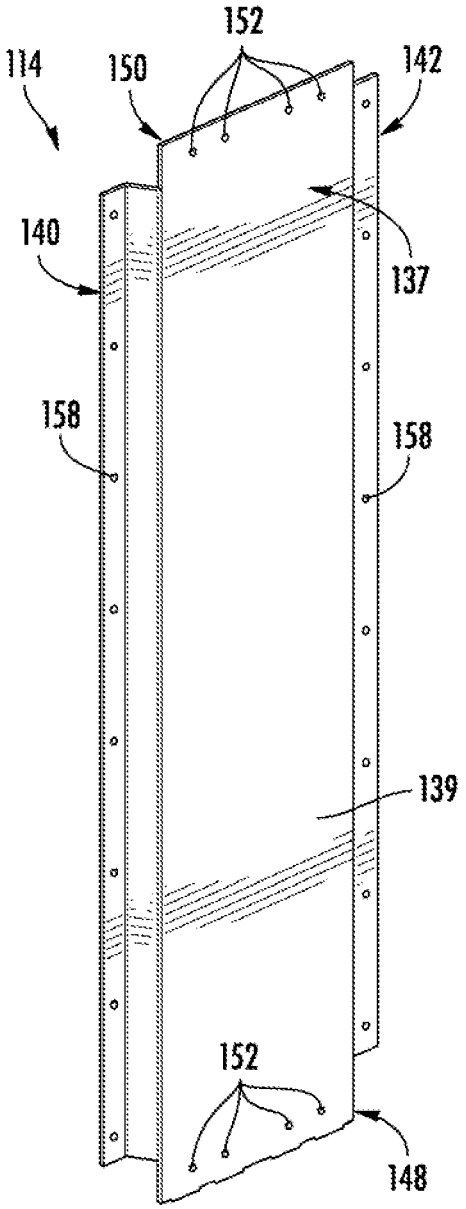
Figure 17:
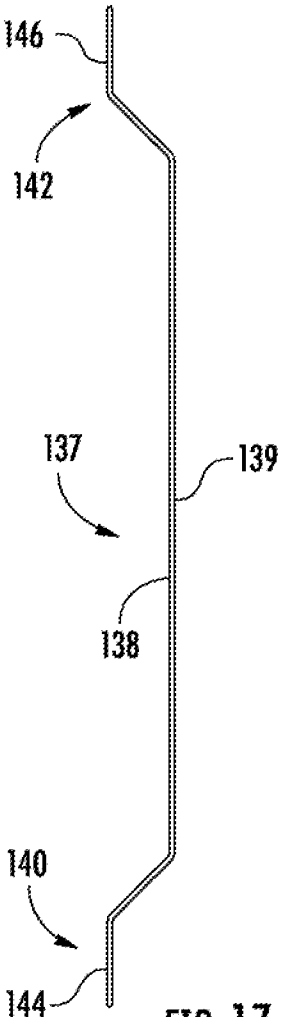
Figure 16:
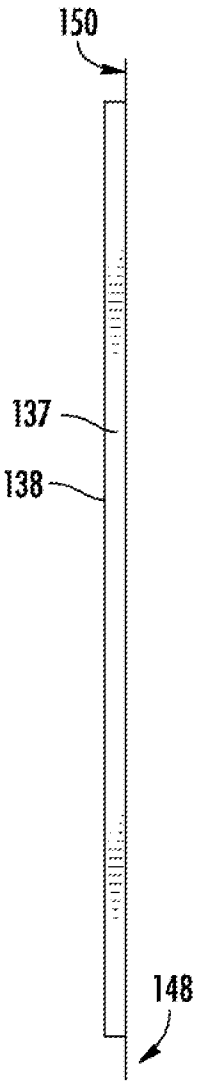
Figure 15:
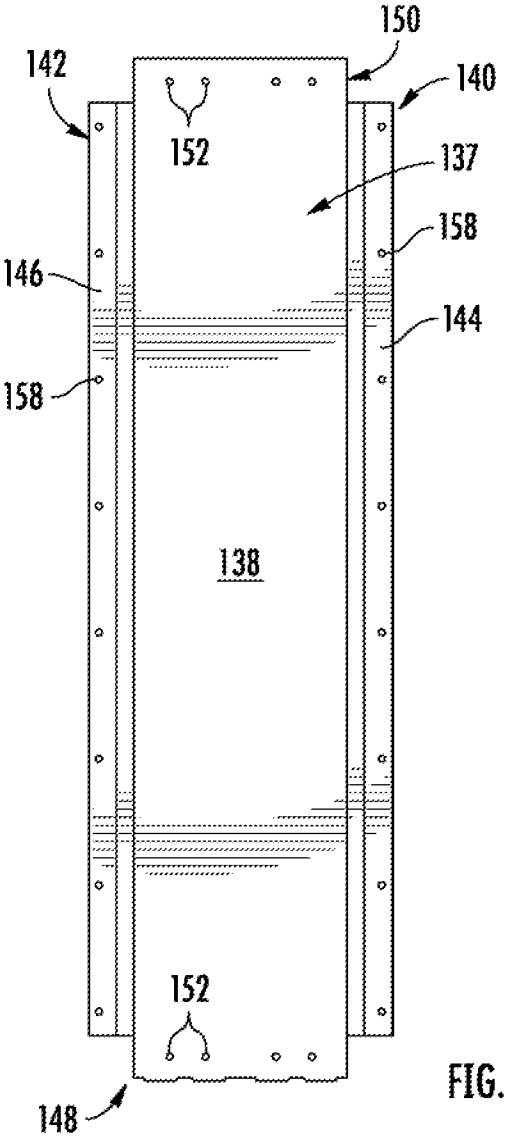
Figure 18:
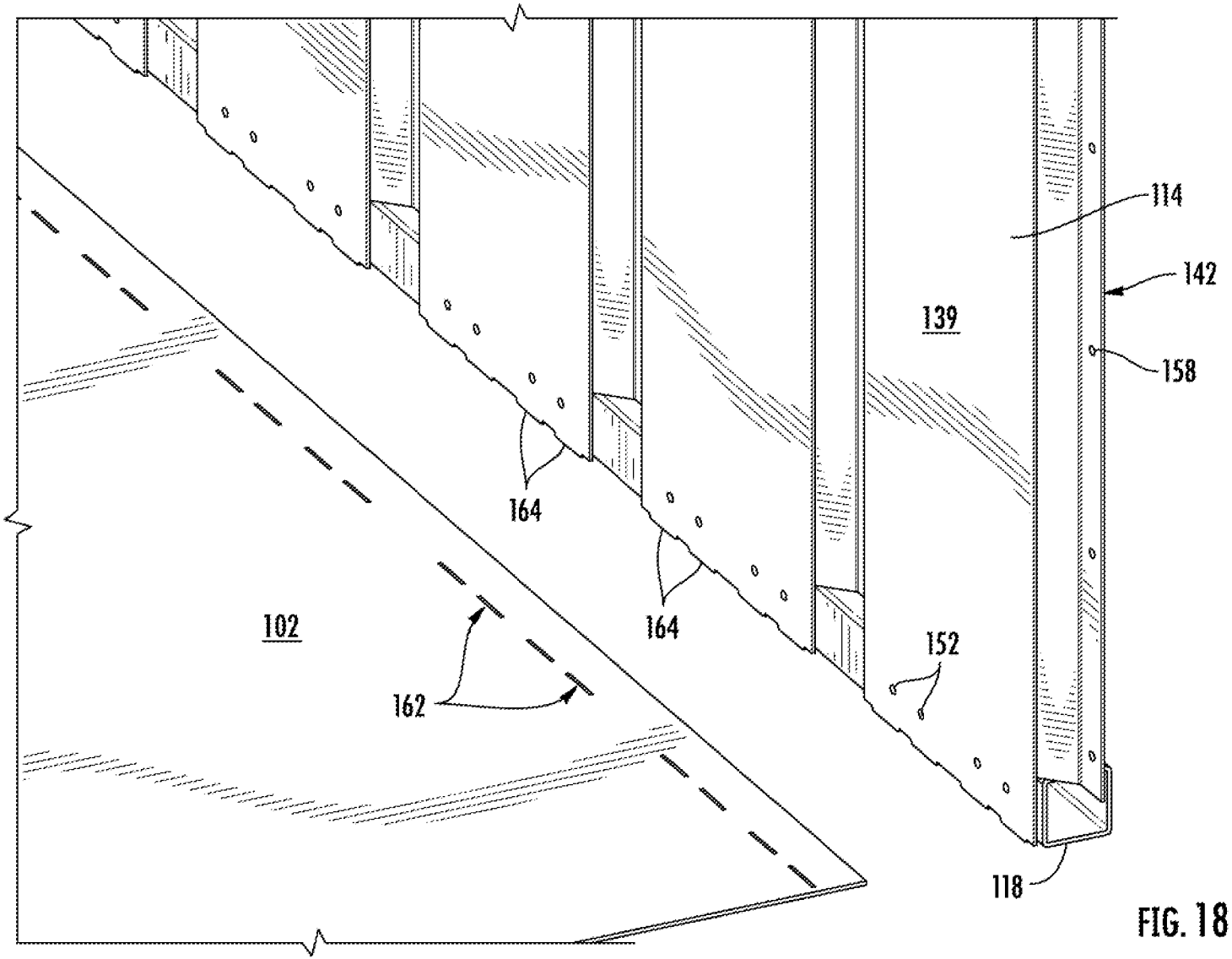
Figure 19:
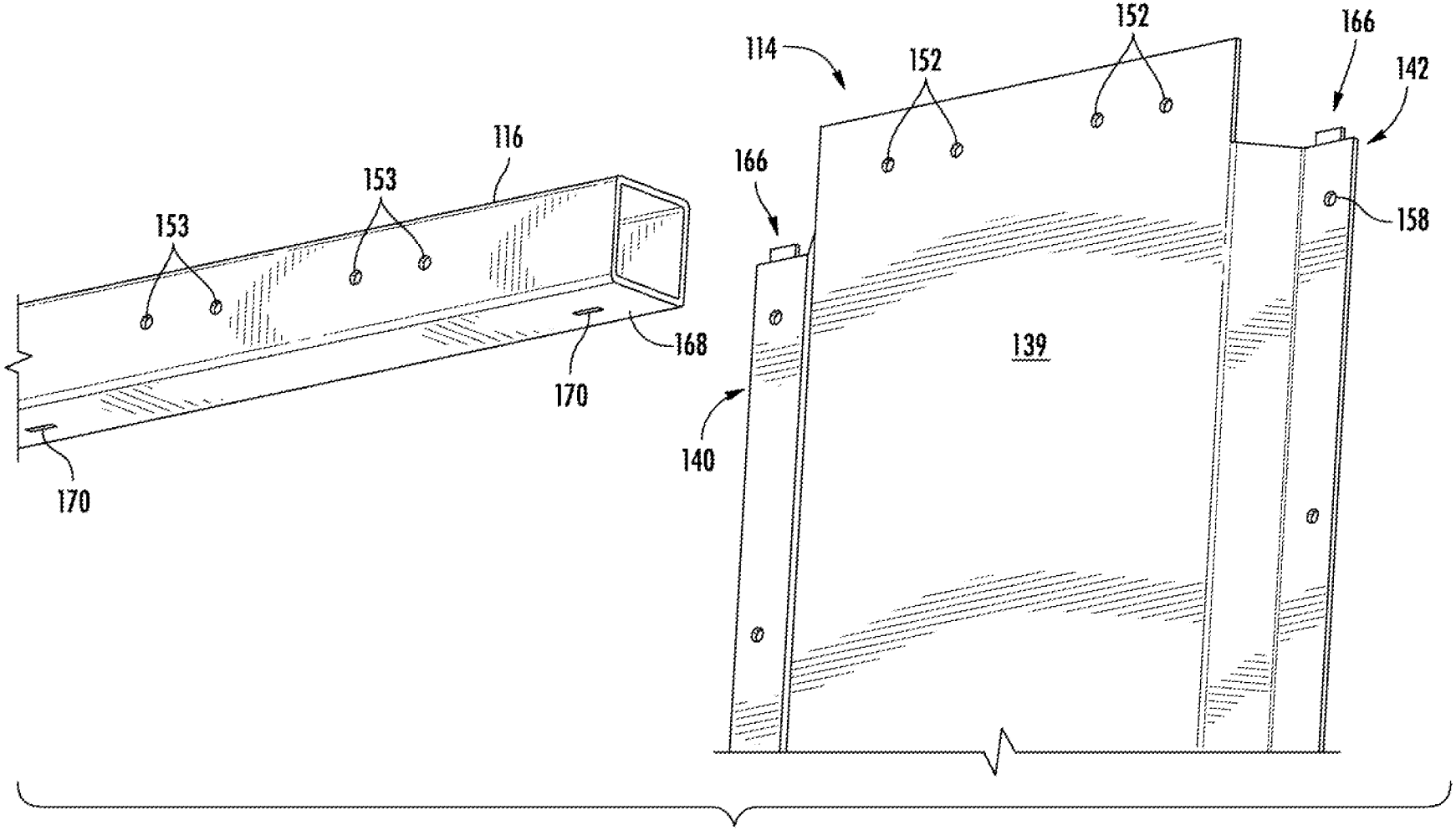
Figure 20:
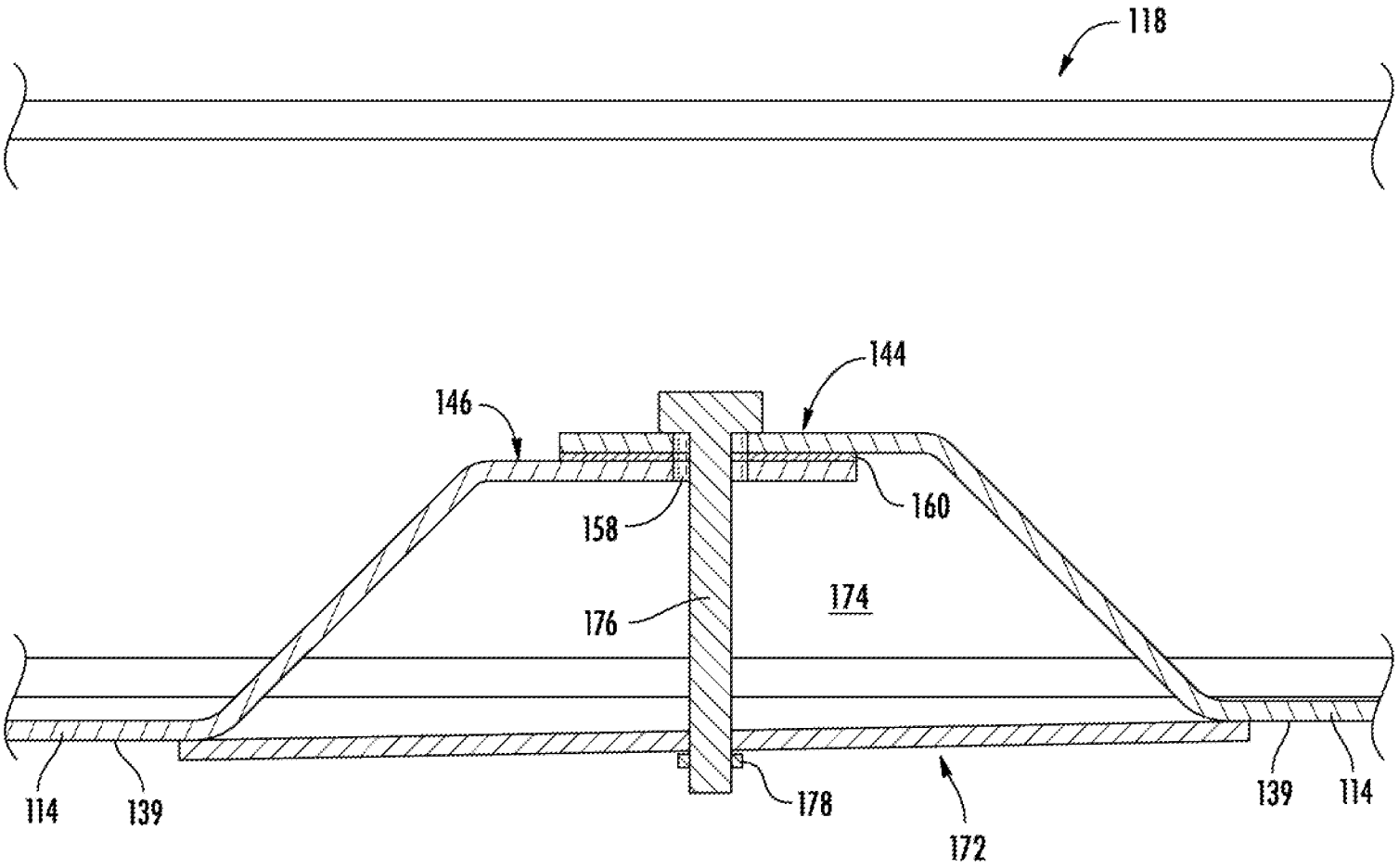
Figure 21:
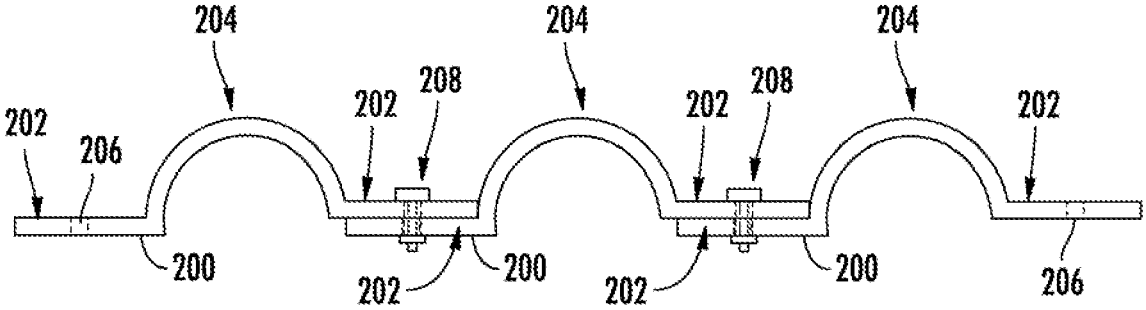
Figure 22:
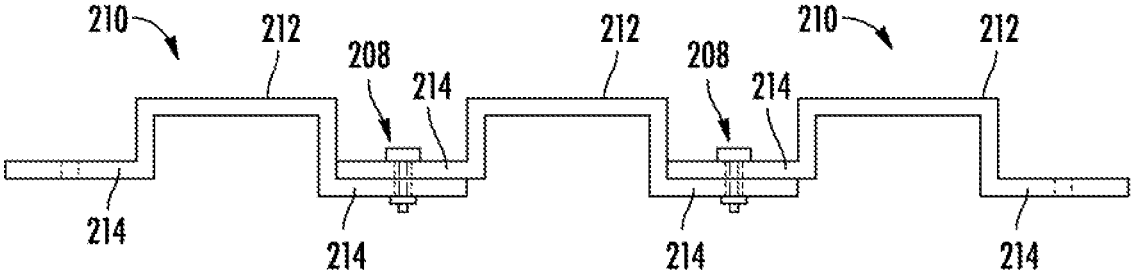
Figure 23:
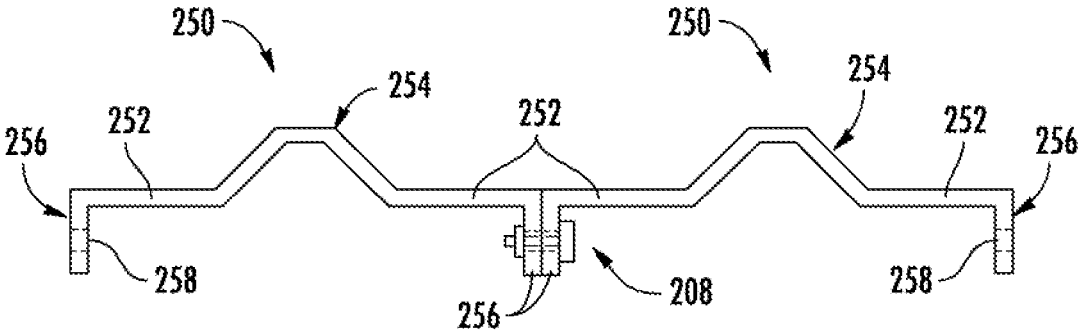
Figure 24:
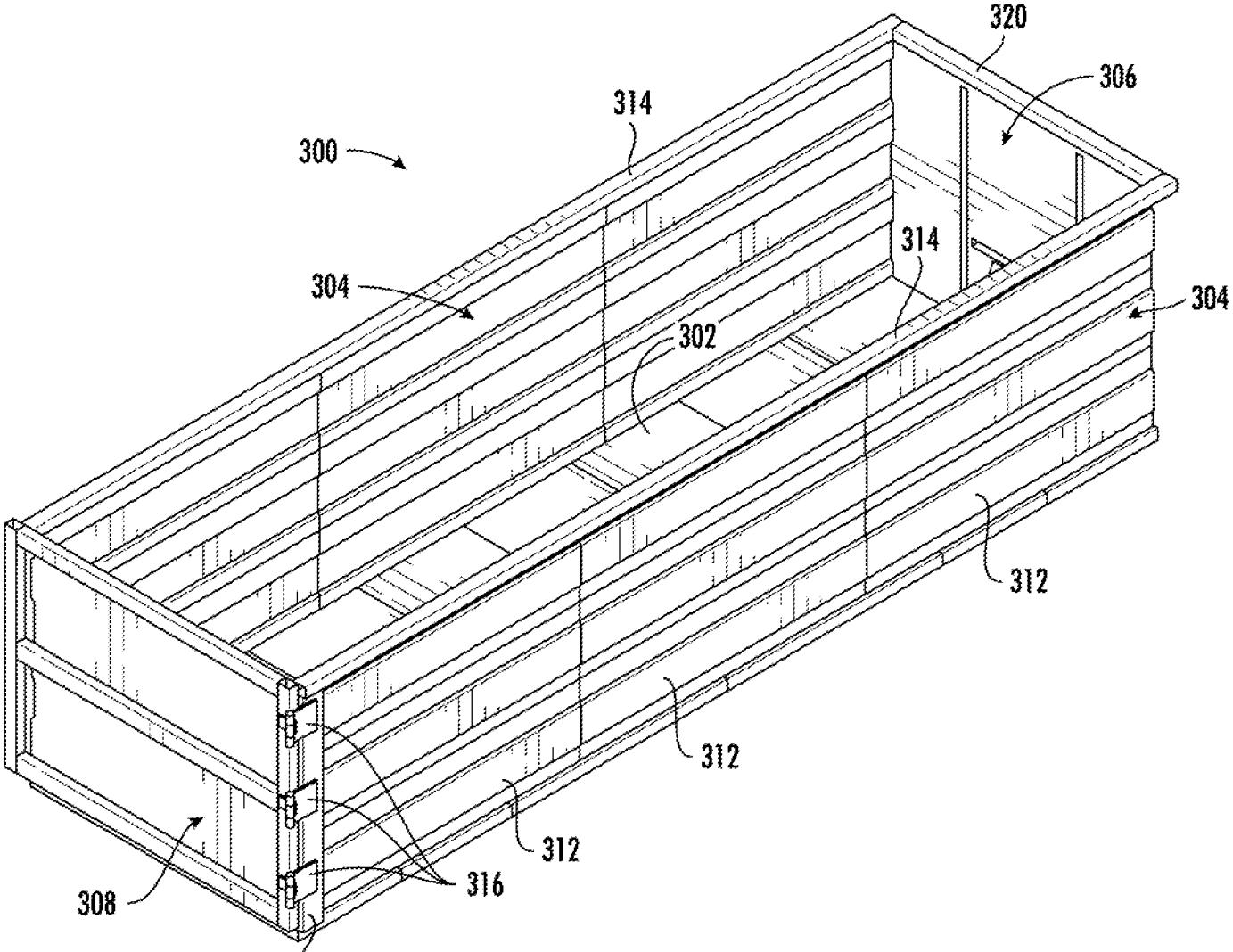
Figure 25:
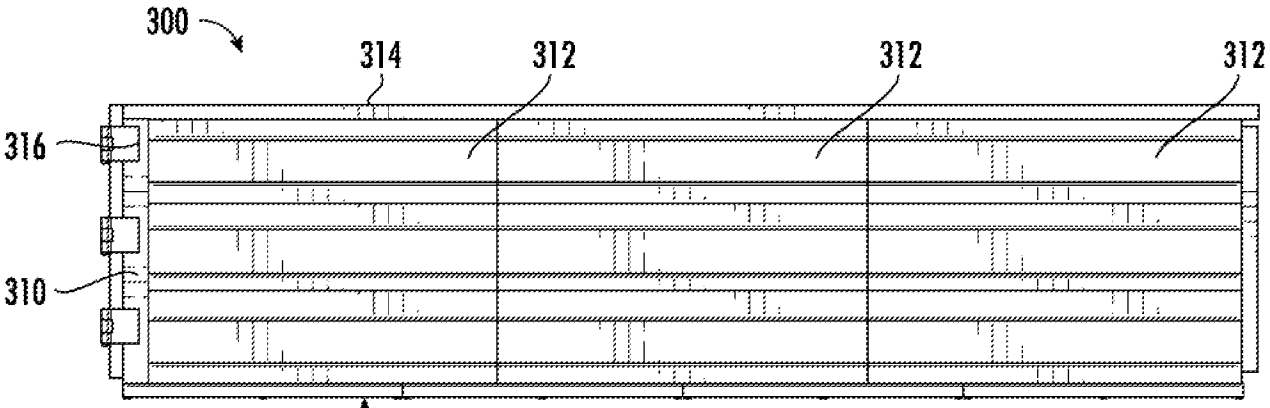
Figure 26:
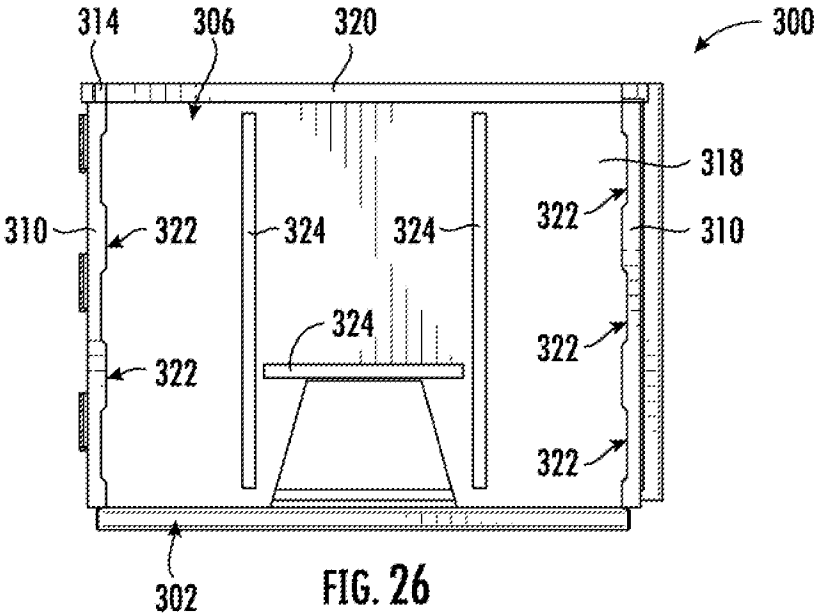
Figure 27:
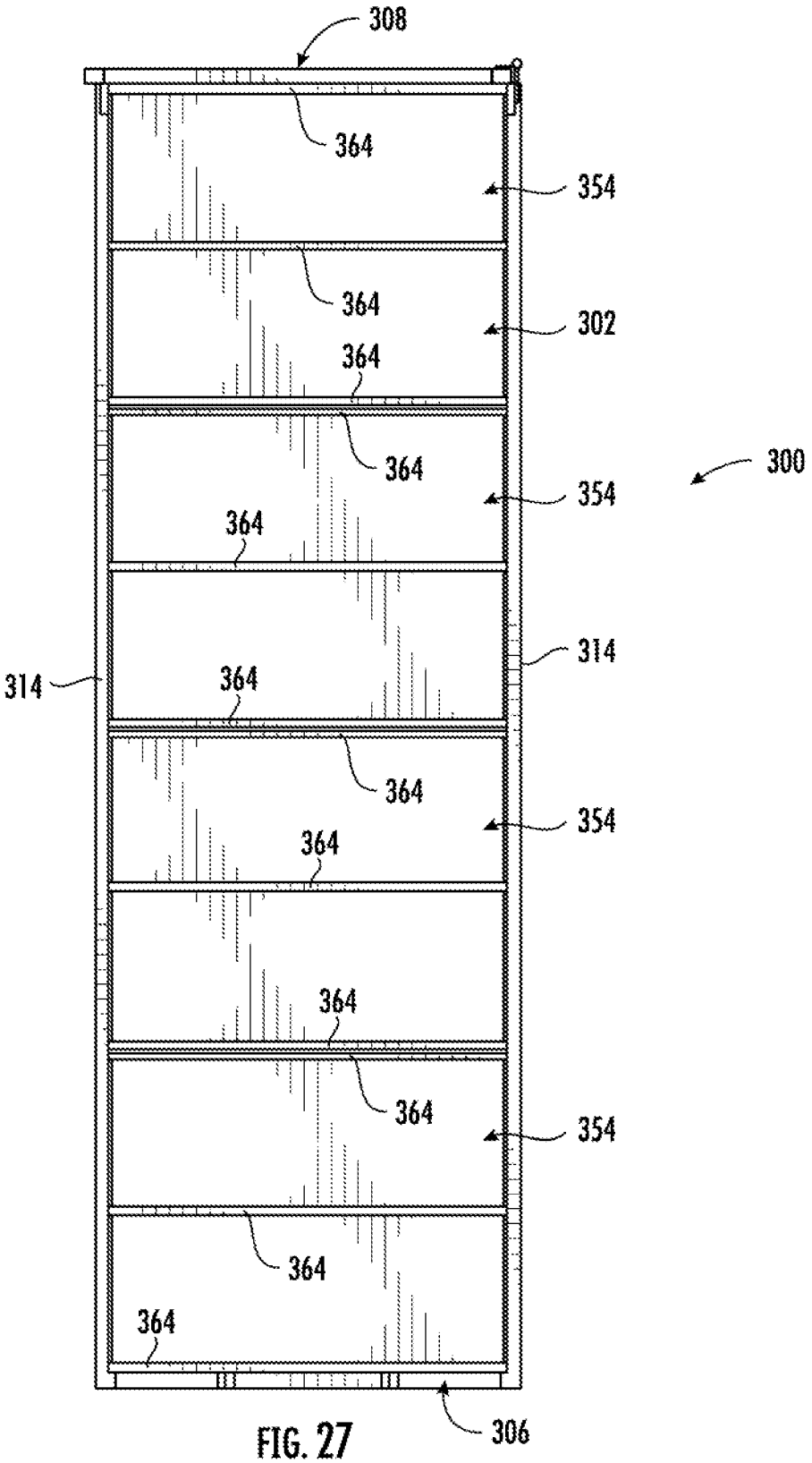
Figure 28:
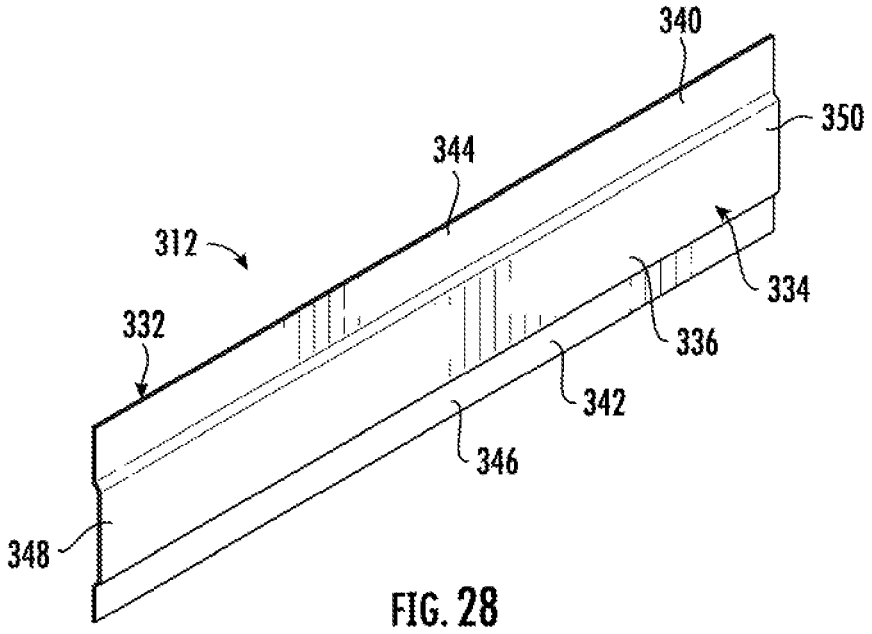
Figure 29:
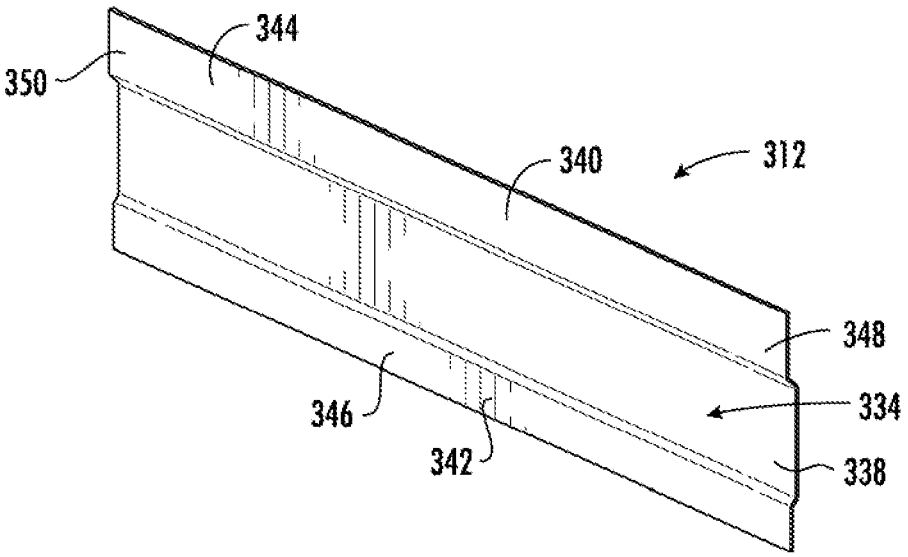
Figure 30:
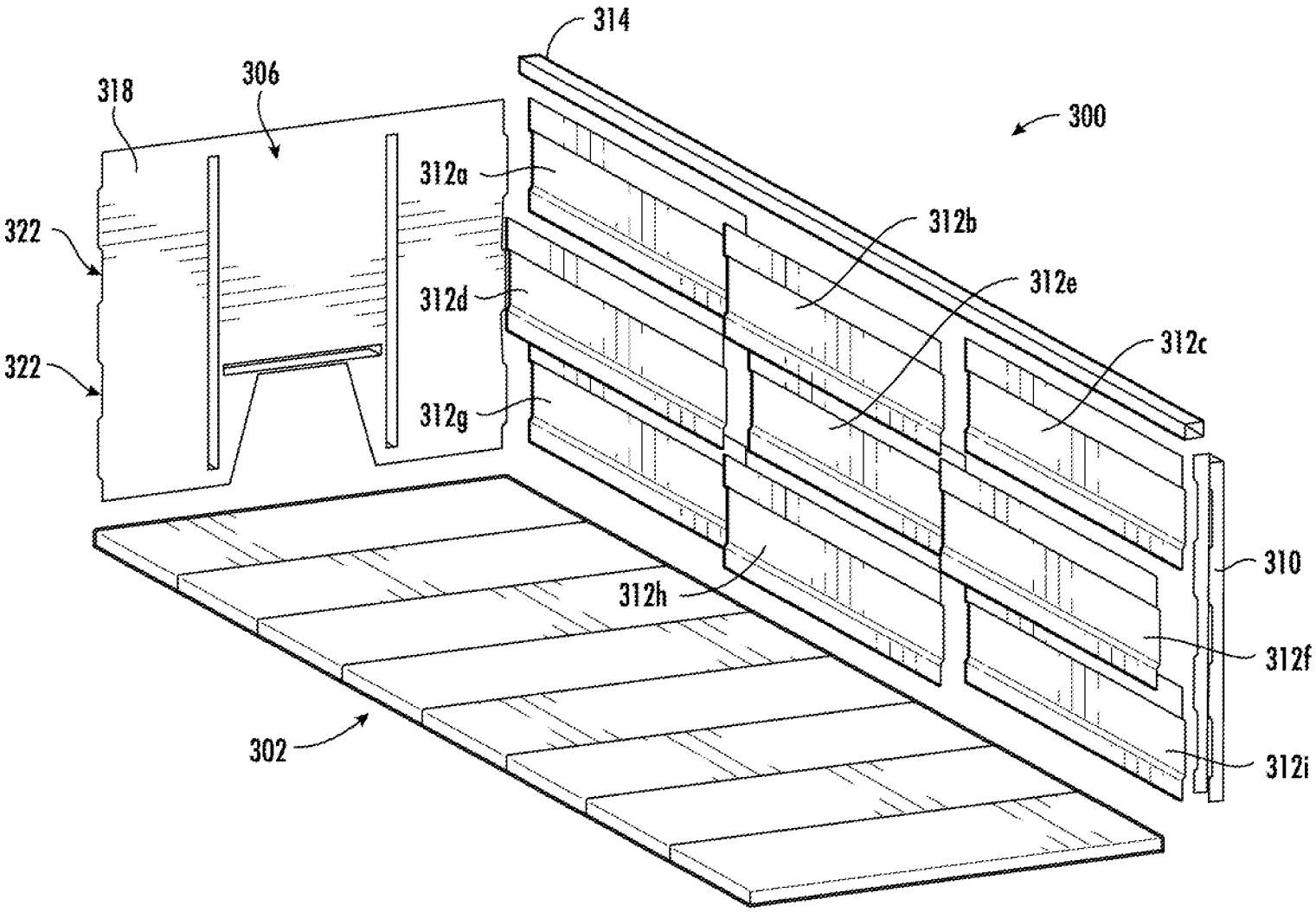
Figure 31:
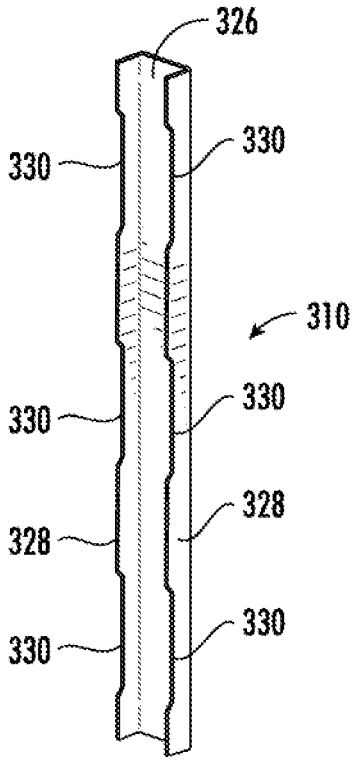
Figure 32:
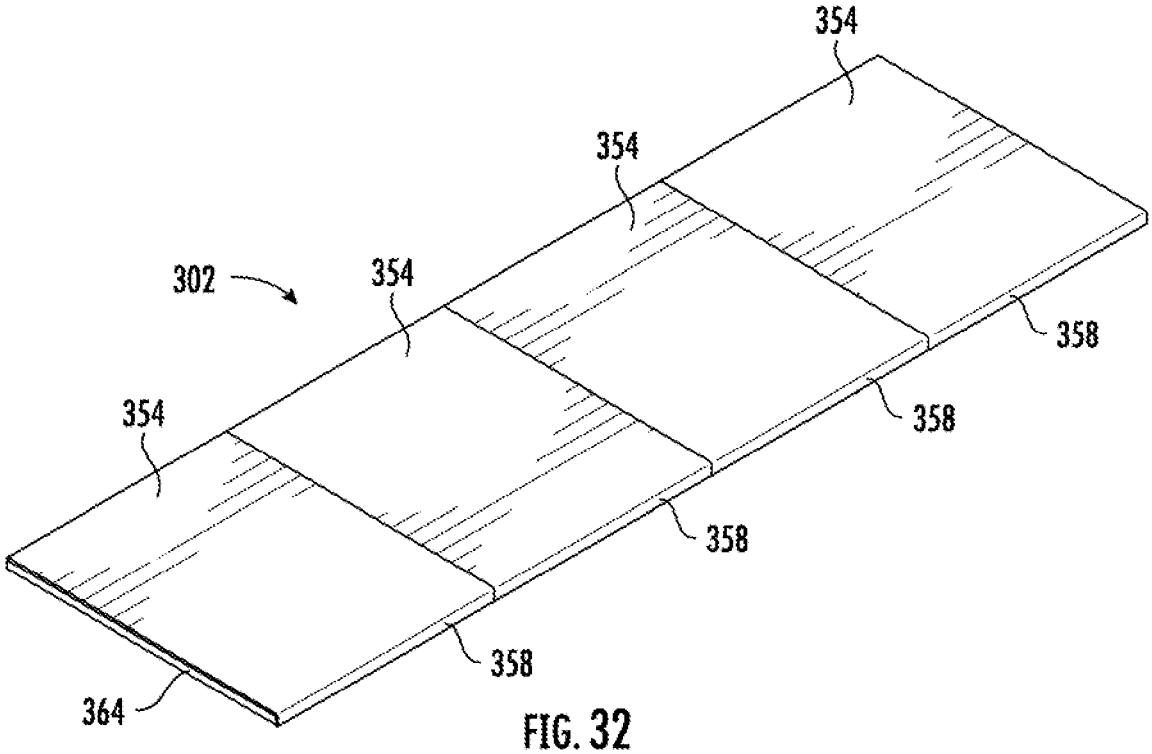
Figure 33:
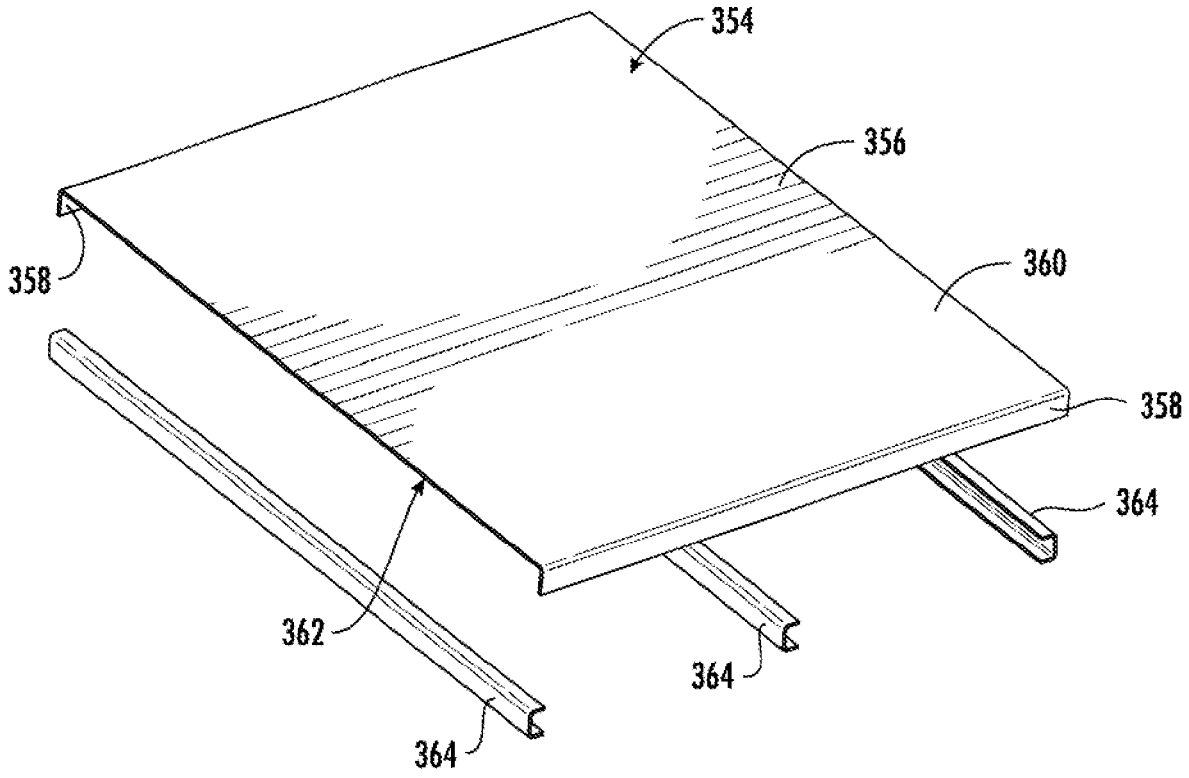
Figure 34:
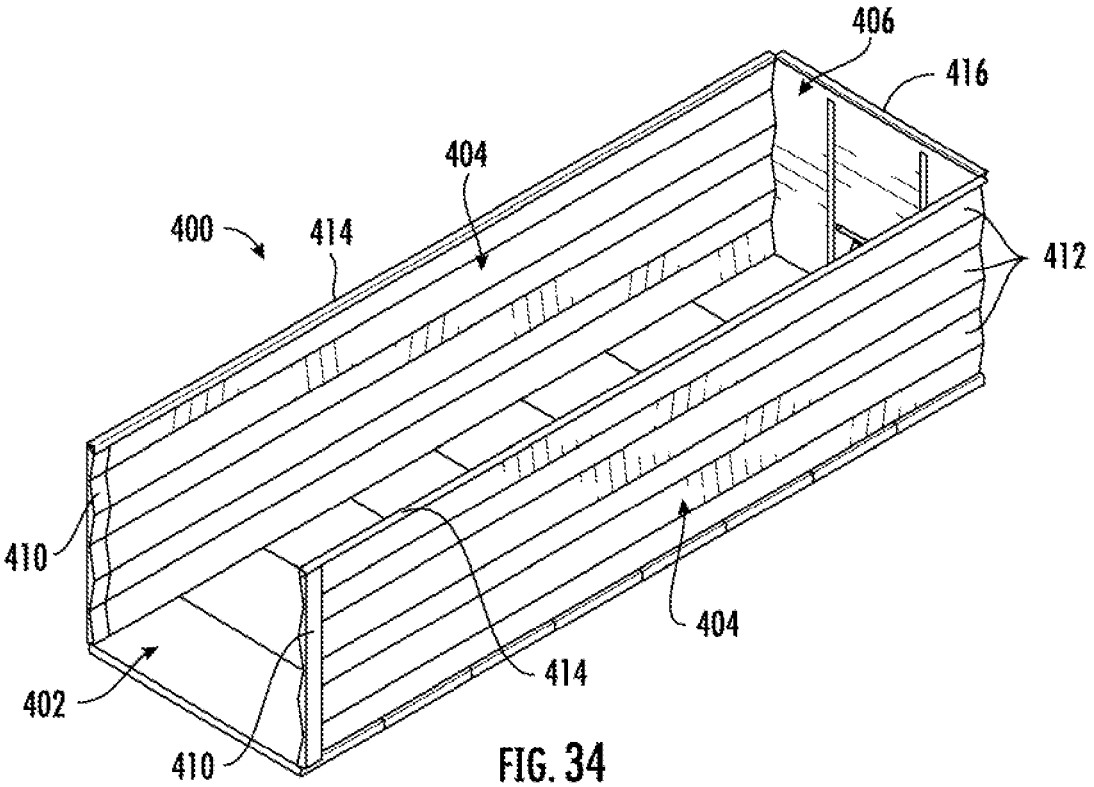
Figure 35:
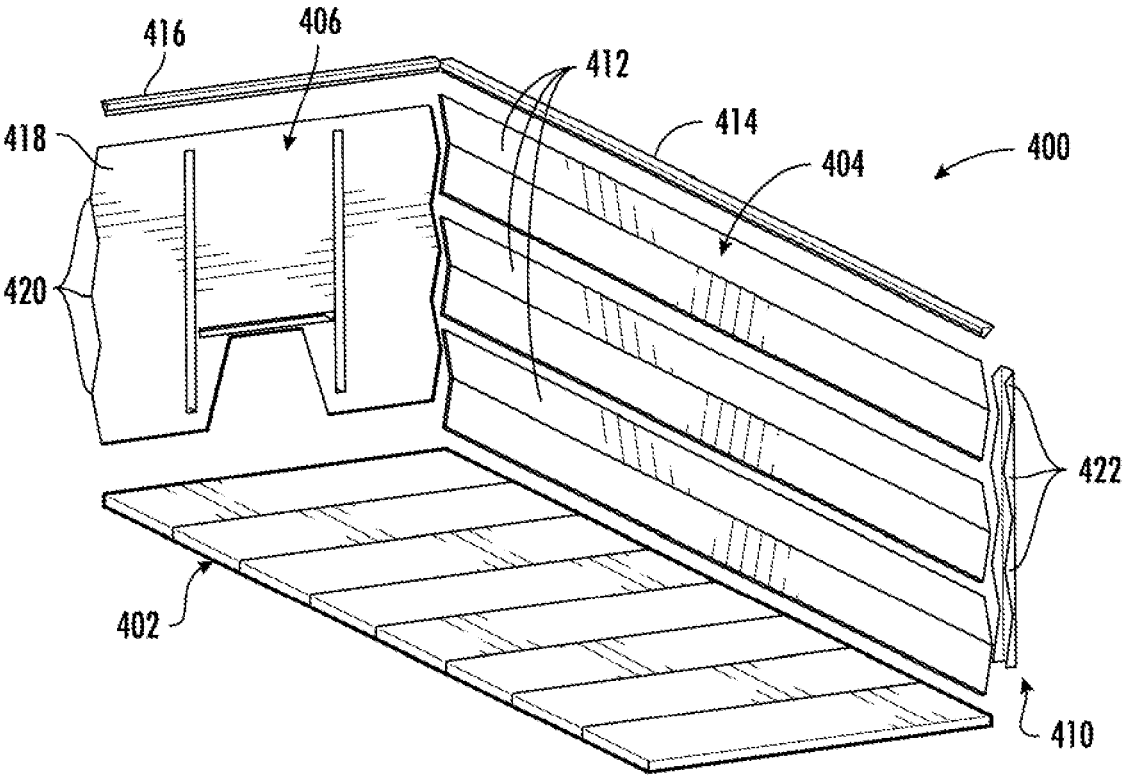

Having thus described some example embodiments in general terms, reference will now be made to the accompanying drawings, which are not necessarily drawn to scale, and wherein:

FIGS. 1-2 are perspective views of a prior art roll-off container;

FIG. 3 is a schematic elevation view of a roll-off container carried on a truck having a hoist apparatus;

FIG. 4A is a side elevation view of a container according to an embodiment of the present invention;

FIG. 4B is a plan view of the container of FIG. 4A;

FIG. 4C is a front elevation view of the container of FIG. 4A;

FIG. 4D is a rear elevation view of the container of FIG. 4A;

FIG. 5 is a front elevation view of a container side wall assembly according to an embodiment of the present invention;

FIG. 6 is a front perspective view of the container side wall assembly of FIG. 5;

FIG. 7 is a rear elevation view of the container side wall assembly of FIG. 5;

FIG. 8 is a rear perspective view of the container side wall assembly of FIG. 5;

FIG. 9 is a cross-sectional view taken along the line 9-9 in FIG. 5;

FIG. 10 is a cross-sectional view taken along the line 10-10 in FIG. 5;

FIG. 11 is a cross-sectional view taken along the line 11-11 in FIG. 5;

FIG. 12 is a detail view of detail A in FIG. 11;

FIG. 13 is a front perspective view of a side panel for a container wall assembly in accordance with an embodiment of the present invention;

FIG. 14 is a rear perspective view of the side panel of FIG. 13;

FIG. 15 is a front elevation view of the side panel of FIG. 13;

FIG. 16 is a side elevation view of the side panel of FIG. 13;

FIG. 17 is a top plan view of the side panel of FIG. 13;

FIG. 18 is a partial exploded perspective view of a container wall assembly and a bottom wall of a container in accordance with an embodiment of the present invention;

FIG. 19 is a partial exploded perspective view of a side panel and top rail of a container wall assembly in accordance with an embodiment of the present invention;

FIG. 20 is a detail cross-sectional view of a container wall assembly in accordance with another embodiment of the present invention;

FIG. 21 is a schematic plan view of three side panels for a container wall assembly in accordance with another embodiment of the present invention;

FIG. 22 is a schematic plan view of three side panels for a container wall assembly in accordance with yet another embodiment of the present invention;

FIG. 23 is a schematic plan view of two side panels for a container wall assembly in accordance with a further embodiment of the present invention;

FIG. 24 is a perspective view of a container in accordance with yet another embodiment of the present invention;

FIG. 25 is a side elevation view of the container of FIG. 24;

FIG. 26 is a front elevation view of the container of FIG. 24;

FIG. 27 is a bottom plan view of the container of FIG. 24;

FIG. 28 is a front perspective view of a side panel of the container of FIG. 24;

FIG. 29 is a rear perspective view of a side panel of the container of FIG. 24;

FIG. 30 is a partial exploded perspective view of the container of FIG. 24, wherein the left side wall assembly and door are not shown;

FIG. 31 is a perspective view of a corner post of the container of FIG. 24;

FIG. 32 is a perspective view of a floor assembly of the container of FIG. 24;

FIG. 33 is an exploded perspective view of one of the panel subassemblies of the floor assembly of the container of FIG. 24;

FIG. 34 is a perspective view of a container in accordance with yet another embodiment of the present invention; and FIG. 35 is a partial exploded perspective view of the container of FIG. 34, wherein the left side wall assembly is not shown.

Repeat use of reference characters in the present specification and drawings is intended to represent same or analogous features or elements of embodiments of the present invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of a container, such as but not limited to "vertical," "horizontal," "upper," "lower," "front," or "rear," refer to directions and relative positions with respect to the container's orientation in its normal intended operation, as indicated in the Figures herein. Thus, for instance, the terms "vertical" and "upper" refer to the vertical direction and relative upper position in the perspectives of the Figures and should be understood in that context, even with respect to an apparatus that may be disposed in a different orientation. The term "substantially," as used herein, should be interpreted as "nearly" or "close to", such as to account for design and manufacturing tolerances of the apparatus.

Embodiments of the present invention relate to improved systems and methods for providing modular refuse container side and/or bottom wall assemblies. As noted above, in various embodiments, a container wall assembly may comprise a plurality of overlapping sheets (e.g., of metal) that are releasably fastened together. In some embodiments, the wall assembly may have a corrugated shape. In some embodiments, the side panels also may be interlocking without the use of fasteners.

Although some preferred embodiments are discussed below in the context of rectangular, open-topped roll-off containers, those of skill in the art will appreciate that the present invention is not so limited. In particular, it is contemplated that embodiments of the present invention may be used with any suitable waste, refuse, or payload container, such as but not limited to tub-style roll-off containers, intermodal containers, dump bodies, front-end load containers, and rear-end load containers. Further, it is contemplated that various embodiments may be used with any one or all of the four container side walls, and/or the top or bottom wall of a container. In certain embodiments, the modular wall assemblies may comprise only part of a wall, rather than the entire wall. Also, although certain embodiments are depicted with a vertically oriented side panel, in other embodiments the side panels may be disposed at an angle to vertical and/or arranged horizontally.

Turning now to the Figures, certain details of a container constructed in accordance with an embodiment of the present invention are described below with reference to FIGS. 4A-4D and 5-18. In general, a container 100 may be a rectangular open-topped roll-off container comprising a bottom wall 102, two side wall assemblies 104 in facing opposition, a front wall 106, and a door 108. Bottom wall 102, side wall assemblies 104, front wall 106, and door 108 are coupled together to define an interior volume therein. In various embodiments, the interior volume may be at least ten (10) cubic yards, though other interior volumes may be defined in other embodiments. Door 108 is coupled with one of side wall assemblies 104 in this embodiment via hinges 110, which permit door 108 to open and close the interior volume of container 100. A latching device 112 may be coupled to one of side wall assemblies 104 to latch door 108 in a closed position as is understood. As those of skill in the art will appreciate, a door 108 may not be provided in all embodiments, and instead a fixed rear wall could be coupled between side wall assemblies 104.

In the past, the side walls of a container like container 100 typically would be formed from a rectangular metal sheet, for example formed of 12 gauge or 7 gauge steel. In the illustrated embodiment, however, each side wall assembly 104 comprises a plurality of side panels 114. The number of side panels 114 provided depends on the size of each side panel, the size or volume and shape of container 100, the orientation of side panels 114, and the particular side of container 100 at issue. Where, as shown, a side wall assembly is provided on the long sides of an open-topped roll-off container and side panels 114 are oriented vertically, in one embodiment ten (10) such panels may be provided. In other embodiments and for other sides of a container, different numbers of panels 114 may be used. In that regard, the embodiment of container 100 shown in the figures comprises side wall assemblies 104 along its two long sides, with front wall 106 and door 108 being analogous to those used in conventional roll-off containers. It will be appreciated, however, that front wall 106 (or a fixed rear wall) may also or alternatively comprise side wall assemblies as described herein in other embodiments. Further, in certain other embodiments, bottom wall 102 and/or a door 108 may also comprise a plurality of side panels 114 or other modular panels, as described herein.

Side wall assemblies 104 also comprise top rails 116 that are releasably fastened (as described in more detail below) with and extend horizontally along an upper edge of side panels 114. In various embodiments, top rails 116 may comprise a length of rectangular metal tubing. The lower edge of side panels 114 may be releasably fastened with bottom rails 118, which are also preferably coupled with bottom wall 102. Corner posts 120, where provided, may be coupled with the lateral edges of a panel 114 and extend between top rails 116 and bottom wall 102. As described in more detail below, in some embodiments projections on side panels 114 together define a plurality of vertical supports 122 that extend vertically between top rails 116 and bottom rails 118. As will be appreciated, such vertical supports 122 may stiffen walls 104 and increase the bending strength thereof.

In this embodiment, front wall 106 may comprise a rectangular metal sheet 124 that extends vertically between a top rail 126 and bottom rails 128 coupled with respective upper and lower edges thereof. Metal sheet 124 also extends laterally between corner posts 120. Bottom rails 128 may also be coupled with bottom wall 102. Corner wraps 130 may be provided between top rails 116 and top rail 126 for added strength. Also, one or more vertical supports 132 may extend vertically between top rail 126 and bottom rails 128 to stiffen or otherwise provide support to front wall 106.

As with container 10 described above, in various embodiments container 100 may also comprise at least two wheels 134. In the illustrated embodiment, four such wheels 134 are provided. A substructure of container 100 may comprise a pair of longitudinal rails 136 which extend generally along the length thereof and which may provide support for bottom wall 102 and facilitate loading, unloading, and transport of container 100 on a hoist frame.

An example container side wall assembly 104 is described in more detail with reference to FIGS. 5-18. In the illustrated embodiment, side wall assembly may be about 8' tall and 22' long, though as noted above the dimensions of side wall assembly 104 will vary depending on the type of container and side wall at issue. Also as noted above, side wall assembly 104 comprises a plurality of side panels 114 that are coupled with top rail 116 and bottom rail 118 via a non-welded connection, such as mechanical fasteners. In various embodiments, suitable fasteners include, but are not limited to, bolts, screws, nails, and other mechanical fasteners. Among many possibilities, suitable bolts may include hex bolts, huck bolts, carriage bolts, and shoulder bolts. In one embodiment, the fasteners may comprise 7/16" bolts and corresponding weld nuts. Nonetheless, those of skill in the art will appreciate that fasteners other than bolts may be suitable in various embodiments. Also, those of skill in the art will appreciate that the type, number, and grade of fasteners used may vary in various applications and for various intended strengths of the container. For higher strengths, the diameter of fasteners may be increased and the number of fasteners used may increase.

In one embodiment, side panels 114 comprise a sheet of suitable strength for refuse disposal environments (e.g., 7 or 12 gauge steel), though other suitable materials may be used. Thus, side panels 114 may be planar in shape. In some embodiments, each side panel 114 may be formed from a single unitary sheet, though this is not required in all embodiments. Side panels 114 also may not comprise a sheet in some embodiments, and may instead define a tubular or double-walled structure. Also, although side panels 114 are illustrated as being generally rectangular, side panels 114 may define any suitable shape in other embodiments.

In any event, as shown, side panels 114 may be generally planar and have a body portion 137 comprising a first surface 138, which may face the exterior of a container upon assembly, and an opposite second surface 139, which may face the interior of a container upon assembly. Side panels 114 in this embodiment also may comprise a first projection 140 and a second projection 142. In other words, in some embodiments, side panels 114 comprise an inner wall portion (e.g., body portion 137) and an outer wall portion (e.g., one or more projections 140, 142) spaced apart from the inner wall portion.

First and second projections 140 and 142 respectively define flanges 144, 146 in this embodiment. Flanges 144 and 146 are spaced apart from body portion 137. In one embodiment, side panels 114 may be stamped and flanges 144, 146 may be defined during the stamping process. In other embodiments, flanges 144, 146 or other projections (as described elsewhere herein) may be defined by folding or bending panels 114 during manufacturing. Further, in some embodiments, projections 140, 142 may not be unitary with body portions 137. Also, in some embodiments, a side panel 114 may comprise only a single projection 140 or 142 or may comprise more than two projections 140 or 142.

As noted above, side panels 114 may be releasably fastened to top rail 116 and bottom rail 118. In this regard, and for example, body portion 137 of each side panel 114 may define a lower end 148 and an upper end 150. Each end 148, 150 defines a plurality of apertures 152 configured to receive suitable fasteners therethrough. In one embodiment, apertures 152 may be about 0.5" in diameter, though again the size may vary. In this embodiment, there are four (4) apertures 152 on each end 148, 150. As shown, e.g., in FIGS. 7-8 and 19, each of top rail 116 and bottom rail 118 also define a plurality of apertures 153. The apertures are positioned so that, when the first surface 138 of body portion 137 is disposed against a respective rear surface 154, 156 of top rail 116 and bottom rail 118, they align with apertures 152. Thereby, each side panel 114 may be releasably fastened to top rail 116 and bottom rail 118 via the fasteners.

Thus, the height dimension of body portion 137 may be selected to correspond to the vertical distance between top rail 116 and bottom rail 118. As shown in FIG. 7, for example, the top edge of side panels 114 may be aligned with the top surface of top rail 116, and the bottom edge of side panels 114 may be aligned with the bottom surface of bottom rail 118. In other embodiments, however, side panels 114 may be releasably fastened to top rail 116 and bottom rail 118 in another manner, and as such the height dimension of body portion 137 may vary in other embodiments. For instance, either or both of lower end 148 and upper end 150 may be partially or entirely bent so that it can be attached to an upper or lower surface of bottom rail 118 and/or top rail 116, rather than to the rear surfaces 156, 154 thereof.

In certain embodiments, each side panel 114 may partially overlap with another side panel 114 when side wall assembly 104 is assembled. The overlapping feature in this embodiment helps maintain both the structural integrity and the watertight properties of conventional containers while eliminating welded seams. For example, either or both projection 140, 142 of each side panel 114 may overlap with another projection 140, 142 of an adjacent side panel 114. More particularly, the locations of the apertures defined in top rail 116 and bottom rail 118 may be selected so that, when side panels 114 are fastened to top rail 116 and bottom rail 118, their relative positions cause a projection 140, 142 of one side panel to overlap with a projection 140, 142 of an adjacent side panel. In other embodiments described in more detail below, side panels 114 may overlap at locations on their respective body portions, rather than at their respective projections. Also, side panels 114 may not overlap at all in still other embodiments.

Additionally, each side panel 114 is releasably fastened to its adjacent side panel(s) 114. In the illustrated embodiment, the flange(s) 144, 146 of each side panel 114 preferably define a plurality of apertures 158. In one embodiment, apertures 158 may be centered on flanges 144, 146 and spaced every 12", though the number of apertures 158 used may vary in other embodiments. As shown, each side panel flange 144, 146 may define eight (8) apertures 158. Apertures 158 preferably are located in each flange 144, 146 so that, when two adjacent side panels 114 are assembled to top rail 116 and bottom rail 118, the apertures 158 in the respective flange 144 or 146 of each side panel 114 will be in alignment (see, e.g., FIGS. 11-12). Accordingly, fasteners (e.g., bolts) may be inserted through the aligned apertures 158 and used to secure side panels 114 together.

As best seen in FIG. 11, in a given container wall assembly 104, side panels 114 may be assembled so that their respective projections 140, 142 alternate between being in front of (or exterior of) the projections 140, 142 of adjacent side panels and being behind (or interior of) the projections 140, 142 of adjacent side panels. For instance, the side panel 114 that is completely shown in FIG. 11 has its projections 140, 142 disposed in front of (or exterior of) the projections 142, 140 of each of its adjacent side panels 114 (which are only partially shown in FIG. 11). However, this particular configuration is not required in all embodiments. Each panel 114 could have its projection 142 disposed behind (or interior of) a projection 140 of one adjacent panel and its projection 140 in front of (or exterior of) a projection 142 of the other adjacent panel, or vice versa. Depending on the material from which each side panel 114 is made, side panel 114 may be flexible enough to allow assembly in any of these configurations. In other embodiments, such as those discussed with regard to FIGS. 21-22 below, side panels 114 may be dimensioned to be assembled in one particular configuration or orientation.

In the illustrated embodiment, flanges 144 and 146 are co-planar and offset from the plane in which body portion 137 lies. Likewise, where the assembly configuration illustrated in FIG. 11 is used, the body portions 137 of adjacent panels will be slightly offset and will not be co-planar. However, this is not required in all embodiments. For instance, flanges 144 and 146 may extend in parallel, but offset planes. Likewise, in some configurations, body portions 137 of adjacent side panels 114 may extend in the same plane, or each body portion 137 may extend in a different plane.

When projections 140, 142 of adjacent side panels 114 are fastened together in this embodiment, they together define the plurality of vertical supports 122 mentioned above. These vertical supports 122 may be analogous in function to the vertical supports 18 of conventional open-topped roll-off containers in some embodiments. When viewed in plan or cross-section, vertical supports 122 may have a polygonal shape in this embodiment, but vertical supports may have any suitable shape in other embodiments.

Vertical supports 122 preferably extend from the top rail 116 to the bottom rail 118. More specifically, in one embodiment, the vertical dimension of projections 140, 142 is preferably selected to correspond to the vertical distance between the top surface of bottom rail 118 and the bottom surface of top rail 116, so that, following assembly, the bottom edges of flanges 144, 146 engage the top surface of bottom rail 118 and the top edges of flanges 144, 146 engage the bottom surface of top rail 116. Thus, projections 140, 142 may be shorter in height than body portion 137 in some embodiments.

Depending on the application for which container 100 will be used, in various embodiments, a suitable gasket material (e.g., rubber gasket 160 in FIG. 20) may be disposed between projections 140, 142 of adjacent side panels 114 to help maintain watertightness. Likewise, in various embodiments, a suitable gasket material also may be disposed between the portions of side panels 114 that are in engagement with top rail. For instance, gaskets could be disposed between body portion 137 and the rear surfaces 154, 156 of top rail 116 and/or bottom rail 118. Gaskets also could be disposed between the bottom surface of top rail 116 and the top edges of flanges 144, 146 and/or between the top surface of bottom rail 118 and the bottom edges of flanges 144, 146. However, gasketing is not required in all embodiments.

With reference now in particular to FIG. 18, as noted above, bottom rail 118 is coupled with a bottom wall 102 of container 100. In some embodiments, one or more side panels 114 also are coupled with bottom wall 102. For example, bottom wall 102 optionally may define a plurality of locating features (e.g., slots 162) and each applicable side panel 114 optionally may define a plurality of correspondingly-sized locating features (e.g., tabs 164). Tabs 164 may extend from lower end 148 of each applicable side panel 114, and may be any suitable shape. As shown, tabs 164 are rectangular in shape. Slots 162 are located in bottom wall 102 and configured to receive tabs 164 and help position side panels 114 during assembly of side wall assembly 104. This or another suitable coupling between side panels 114 and bottom wall 102 also may add rigidity to container 100.

FIG. 19 is an exploded view of a side wall 114 and top rail 116 in accordance with another embodiment. Here, top rail 116 and projections 140, 142 may define similar locating features. For instance, projections 140, 142 may each comprise one or more tabs 166 extending vertically from upper edges thereof. A bottom surface 168 of top rail 116 may define correspondingly sized slots 170 that are located and configured to receive tabs 166 during assembly of side wall assembly 104. In various embodiments, tabs also could be disposed on the lower edges of projections 140, 142 and configured to mate with corresponding slots defined in a top surface of bottom rail 118. Any such tabs may be provided in addition to or in the alternative to the tabs described with reference to FIG. 18 in various embodiments.

FIG. 20 is a detail cross-sectional view of a container wall assembly in accordance with another embodiment of the present invention. This figure is analogous to the view of FIG. 12, but in this embodiment, the container wall assembly comprises one or more interior wall plates 172. As shown, wall plates 172 optionally may be provided between adjacent side panels 114 at locations opposite the overlapping flanges 144, 146. Thus, wall plates 172 may be located on the interior wall (e.g., second surface 139) side of wall assembly 104. Wall plates 172 may be provided, for example, to create a more uniform interior wall in container 100 and to increase the watertightness of container 100. Wall plates 172, where provided, may also increase the strength and rigidity of container 100 and vertical supports 122. Wall plate 172 may be rectangular in shape and sized to fill and/or cover a recess 174 in the interior wall created by projections 140, 142. In the illustrated embodiment, wall plate 172 is wider than recess 174 so that its lateral edges abut second surface 139 of side panels 114. In other embodiments, wall plate 172 could be dimensioned to be received with recess 174 in other embodiments such that the interior-facing side of wall assembly 104 defines a continuous, smooth surface. Wall plate 172 may be coupled with side panels 114 via a bolt 176 that is received through apertures 158 defined in flanges 144, 146 and a nut 178 that is received on bolt 172 and tightened against wall plate 172.

It is contemplated that, in various embodiments, side panels of a container wall assembly may have cross-sectional shapes that differ from the cross-sectional shape of side panels 114 described above. Each side panel may be the same as its adjacent side panel(s) in some embodiments, but that is not required. Alternating side panels, or portions thereof, could have different dimensions or shapes, including differing thicknesses and/or widths.

In that regard, and turning now to FIG. 21, a portion of a side wall assembly comprising three side panels 200 is schematically illustrated in plan view. In this embodiment, each side panel 200 defines a body portion 202 and a projection 204. Unlike side panels 114 described above, here side panels 200 are releasably fastened together at their respective body portions 202, rather than at their respective projections 204. Body portions 202 define apertures 206 in which bolts 208 are received to releasably fasten side panels 200 to one another. Thus, in this embodiment, each side panel comprises its own vertically extending support, unlike the vertical supports 122 that were formed by the assembly of the projections of adjacent side panels.

Also unlike side panels 114, in this embodiment, projections 204 are semicircular when viewed in plan or cross-section. Further, in this embodiment, each side panel 200 is not symmetrical when viewed in plan. Rather, the left-hand side of the body portion 202 is disposed in a plane that is parallel with but offset from (e.g., behind or interior of) the plane in which the right-hand side of body portion 202 lies.

In the embodiment of FIG. 22, side panels 210 define projections 212 that are rectangular in shape when viewed in plan or cross-section. Also, in this embodiment, the width of each projection 210 is greater than the width of body portions 214. In this embodiment, unlike the embodiment of FIG. 21, the plane in which the left-hand side of body portion 214 lies is in front of (or exterior of) the plane in which the right-hand side of body portion 214 lies.

FIG. 23 illustrates an embodiment including two side panels 250. In this embodiment, side panels 250 are releasably fastened together but do not overlap one another. In particular, side panels 250 comprise a body portion 252 and a projection 254 therefrom. Body portion 252 also defines two lateral flanges 256. Each flange 256 defines an aperture 258 configured to receive a suitable fastener, such as a bolt 208. When side panels 250 are disposed side-by-side, flanges 256 of adjacent panels are in engagement, and their respective apertures 258 are in alignment. In the illustrated embodiment, flanges 256 extend toward the interior volume of a container, opposite the direction of projections 254. In other embodiments, flanges 256 could extend in the same direction as projections 254.

A container 300 constructed in accordance with yet another embodiment of the invention is shown in FIGS. 24-33. In this regard, FIGS. 24-27 are perspective, side elevation, rear elevation, and bottom plan views of container 300, respectively. FIGS. 28 and 29 are front and rear perspective views of a side panel of container 300. FIG. 30 is a partial exploded perspective view of container 300, wherein the left side wall assembly and door are not shown. FIG. 31 is a perspective view of a corner post of container 300. FIG. 32 is a perspective view of a floor assembly of container 300, and FIG. 33 is an exploded perspective view of one of the panel subassemblies of the floor assembly of container 300.

In this embodiment, container 300 is a rectangular open-topped roll-off container comprising a floor assembly 302, two side wall assemblies 304 in facing opposition, a front wall 306, and a door 308. Floor assembly 302, side wall assemblies 304, front wall 306, and door 308 are coupled together to define an interior volume therein. In various embodiments, the interior volume may be at least ten (10) cubic yards, though other volumes may be defined in other embodiments. Also, in various embodiments, each side wall assembly 304 may be about 8' tall and 22' long, though again these dimensions will vary depending on the type of container and side wall at issue.

Here, each side wall assembly 304 of container 300 comprises a corner post 310, a plurality of side panels 312, and a top rail 314. The number of side panels 312 depends on the size of each side panel, the size or volume and shape of container 300, the orientation of side panels 312, and the particular side of container 300 at issue. Where, as shown, a side wall assembly is provided on the long sides of an open-topped roll-off container, in one embodiment nine (9) such panels may be provided in each side wall assembly 304. As described in more detail below, in this embodiment, side panels 312 are oriented horizontally (e.g., with a longitudinal axis 315 of each side panel 312 being parallel with an axis defined along the long dimension of container 300), rather than vertically or at another angle. Of course, in other embodiments and for other sides of a container, different numbers and configurations of panels 312 may be used. Again, in the embodiment of container 300, a plurality of side panels 312 also could be used for any of front wall 306, door 308, and/or floor assembly 302.

Door 308 is coupled with one of side wall assemblies 304 in this embodiment via hinges 316 coupled with one of the corner posts 310. Hinges 316 permit door 308 to open and close the interior volume of container 300. As those of skill in the art will appreciate, door 308 may not be provided in all embodiments, and instead a fixed rear wall could be coupled between side wall assemblies 304.

Top rails 314 are coupled with corner posts 310 and extend horizontally along an upper edge of three side panels 312 in this embodiment. As shown, top rails 314 comprise a length of rectangular metal tubing. In this embodiment, bottom rails analogous to bottom rails 118 of container 100 above are not provided, but they can be in other embodiments. Corner posts 310 are coupled with the lateral edges of several side panels 312 and extend between top rails 314 and floor assembly 302. In various embodiments, corner posts 310 can be coupled with floor assembly 302 via any suitable method, including mechanical fasteners as described herein or via welding, either alone or in combination with locating features such as those described above in connection with FIG. 18. In a mechanically-fastened application, various embodiments may also include a mounting bracket and/or securing gusset.

In this embodiment, front wall 306 comprises a rectangular metal sheet 318 that extends vertically between a top rail 320 and floor assembly 302. Again, in some embodiments, a bottom rail analogous to bottom rail 128 may be provided. In various embodiments, front wall 306 can be coupled with floor assembly 302 in the same manner as corner posts 310, described in the preceding paragraph. Top rail 320 is coupled at each of its ends with one of top rails 314. Metal sheet 318 also extends laterally between the lateral edges of several side panels 312 of each side wall assembly 304. As best seen in FIGS. 26 and 30, the lateral edges of metal sheet 318 may define a shape that corresponds to the shape of the panels 312 that form each side wall assembly 304. For instance, rather than defining a straight vertical edge, the edges of metal sheet 318 may define a plurality of notches 322 so that the edges of sheet 318 correspond to the profile of each side wall assembly 304. Alternatively, in some embodiments, metal sheet 318 could define one or more flanges that project from the edges shown in FIG. 26 perpendicularly from metal sheet 318 toward the interior volume of container 300. Such flanges may be shaped to define a surface that corresponds to an interior surface of the connected side panels 312 of side wall assembly 304 so that the side panels 312 and flange can be coupled together (e.g., releasably fastened). In some embodiments, metal sheet 318 may be formed from a stamping process, and flanges, if provided, may be bent from metal sheet 318. Of course, other methods of forming flanges, if provided, and of connecting metal sheet 318 and side panels 312 are within the scope of the present invention. In various embodiments, one or more horizontal and/or vertical support members 324 can extend along metal sheet 318 to stiffen or otherwise provide support to front wall 306.

Referring now also to FIG. 31, corner posts 310 in this embodiment comprise a metal channel having a body portion 326 and a pair of flanges 328 that project perpendicularly from body portion 326. In other embodiments, corner posts 310 could comprise rectangular metal tubing or the like. Here, during assembly, posts 310 are arranged so that flanges 328 face the interior volume of container 300. Similar to the edges of metal sheet 318, described above, the distal edges of each flange 328 define a shape that corresponds to the shape of the panels 312 that form the side wall assembly 304 that will be connected with a given post 310. For instance, rather than defining a straight vertical edge, the edges of each flange 328 define a plurality of notches 330 so that the flanges mate flush with a side wall assembly 304 once assembled together. Alternatively, in some embodiments, corner posts 310 could define one or more interior surfaces that extend partially or completely between flanges 328 and that define apertures that align with corresponding apertures in the panels 312 to which they will be connected. In some embodiments, corner posts 310 need not have notches at all, and they may instead define a straight length of metal tubing or metal channel that can be coupled (e.g., releasably fastened) with one or more side panels 312.

Although not shown in this embodiment, in various embodiments container 300 may also comprise wheels analogous to wheels 134, described above. Also, a substructure of container 300 can comprise a pair of longitudinal rails analogous to rails 136, described above.

Side wall assemblies 304 in this embodiment are described with particular reference to FIGS. 24 and 28-30. As noted above, each side wall assembly 304 comprises a plurality of side panels 312 that, in various embodiments, can be coupled together via a non-welded connection, such as mechanical fasteners. However, in certain embodiments, welding could be used to fasten side panels together alone or in addition to the use of mechanical fasteners. In the configuration shown in these figures, certain side panels 312 are coupled with top rail 314, certain are coupled with corner post 310, certain are coupled with floor assembly 302, and certain are coupled with metal sheet 318 of front wall 306. In various embodiments, the side panels 312 that are to be coupled to the floor assembly 302 and to front wall 306 can be so coupled in the same manner as corner posts 310, described above. In this regard, a side panel 312 as shown in FIGS. 28-29 can define a plurality of apertures at various positions around its perimeter that, during assembly, can be aligned with correspondingly-defined apertures in other side panel(s) 312, corner posts 310, and/or top rail 314 (not shown, but analogous to those described above in connection with container 100) to releasably fasten these various components to one another. As those of skill in the art will appreciate, the number and placement of apertures in a given side panel 312 will depend on its location within a side wall assembly 304, and each side panel 312 may not have the same number and/or configuration of apertures as the other side panels 312. Thus, apertures in side panel 312 are not shown in this embodiment, but they can be analogous to the apertures 152 of side panels 114 shown above, and the apertures in corner posts 310 and/or top rail 314 can be analogous to apertures 153, described above. In various embodiments, suitable fasteners include, but are not limited to, bolts screws, nails, and other mechanical fasteners such as those described in connection with container 100 above, and of course the type, number, and grade of fasteners used will vary, as needed or desired, in various embodiments.

In this embodiment, side panels 312 comprise a metal sheet of suitable strength for refuse disposal applications (e.g., 7 or 12 gauge steel), though other suitable materials may be used. Side panels 312 can be generally planar in shape and formed from a single unitary sheet, though this is not required in all embodiments. As with side panels 114 above, side panels 312 also could comprise a tubular or double-walled structure in other embodiments. Although side panels 312 are illustrated as being generally rectangular, side panels 312 can define any suitable shape in other embodiments.

As shown, side panels 312 define a body portion 334 comprising a first surface 336, which may face the exterior of a container upon assembly, and an opposite second surface 338, which may face the interior of a container upon assembly. Of course, the orientation of surfaces 336, 338 may be reversed in other embodiments. Side panels 312 in this embodiment also define a first projection 340 and a second projection 342. Side panels 312 can, in some embodiments, comprise an inner wall portion (e.g., one or more projections 340, 342) and an outer wall portion (e.g., body portion 334). Thus, side panels 312 in this embodiment are analogous in certain respects to side panels 114 described above, although the body portion 334 is different in dimensions than body portion 137, projections 340, 342 are different in dimension from projections 140, 142, and projections 340, 340 do not define flanges analogous to flanges 144, 146 of side panels 114. In some embodiments, side panels 312 can be formed of stamped metal, and projections 340, 342 may be defined by folding or bending panels 312 during manufacturing. It is also not required that projections 340, 342 be unitary with body portion 334 in all embodiments. In various embodiments, a side panel 312 can define only a single projection 340 or 342 or more than two projections 340, 342.

Also in this embodiment, side panels 312 define an upper end 344, a lower end 346, a first lateral end 348, and an opposite second lateral end 350. As noted above, in various embodiments, various side panels 312 can be releasably fastened to one another, to top rail 314, to corner post 310, to floor assembly 302, and/or to front wall 306. For example, with reference to the exploded view of FIG. 30, in which the second surfaces 338 of nine (9) side panels 312 are visible, three (3) side panels 312*a*, 312*b*, and 312*c* together form a first, or top, row of side panels. These side panels can be releasably fastened with top rail 314 via apertures defined along their respective upper ends 344 that are configured to receive suitable fasteners therethrough. Top rail 314 can define a plurality of apertures that are positioned so that, when the first surfaces 336 are disposed against the interior-facing surface 352 of top rail 314, they align with the apertures defined in the upper ends 344 of side panels 312. Thereby, each side panel 312 can be releasably fastened to top rail 314. Where a bottom rail is provided, other side panels 312 could similarly be attached to the bottom rail. Additionally, as shown, lateral end 350 of side panel 312*a* is releasably fastened with metal sheet 318 of front wall 306, and lateral end 348 of side panel 312*c* is releasably fastened with corner post 310.

Lateral end 348 of side panel 312*a* is releasably fastened with lateral end 350 of side panel 312*b*, and lateral end 350 of side panel 312*c* is releasably fastened with lateral end 348 of side panel 312*b*. Specifically, and for example, side panel 312*a* may define one or more apertures defined on lateral end 348, and side panel 312*b* may define one or more apertures defined on lateral end 350. These respective apertures can be positioned so that when panels 312*a* and 312*b* are arranged side by side with lateral end 348 of side panel 312*a* disposed either in front of or behind lateral end 350 of side panel 312*b* (relative to the exterior of container 300), the respective apertures are in alignment and suitable fasteners can be used in the apertures to couple side panel 312*a* with side panel 312*b*. In other words, in this embodiment, side panels 312*a* and 312*b* can overlap by a predetermined amount in the lateral direction. Lateral end 350 of side panel 312*c* can be releasably fastened with lateral end 348 of side panel 312*b* in a similar, partially overlapping fashion. Thus, side panels 312*b* and 312*c* also can overlap by a predetermined amount in the lateral direction. In this embodiment, the lateral distance between corner post 312 and metal sheet 318 can be less than the sum of the lengths of panels 312*a*, 312*b*, and 312*c*.

Also, three (3) side panels 312*d*, 312*e*, and 312*f* together form a second, or middle, row of side panels in this embodiment. These side panels can be releasably fastened with each other in partially overlapping fashion, with metal sheet 318 of front wall 306, and with corner post 310 in the same manner described above. The respective upper ends 344 of each of these side panels 312*d*, 312*e*, and 312*f* are releasably fastened with respective lower ends 346 of each of the side panels 312*a*, 312*b*, and 312*c*. In this regard, upper end 344 of side panel 312*d* can partially overlap with (either in front of or behind relative to the exterior of container 300) lower end 346 of side panel 312*a*, such that one or more apertures defined in upper end 344 of side panel 312*d* come into alignment with one or more corresponding apertures defined in lower end 346 of side panel 312*d*. Upper ends 344 of side panels 312*e* and 312*f* are releasably fastened with respective lower ends 346 of side panels 312*b* and 312*c* in the same, partially overlapping manner Similarly, three (3) side panels 312*g*, 312*h*, and 312*i* together form a third, or bottom, row of side panels in this embodiment. These side panels can be releasably fastened with each other in partially overlapping fashion, with metal sheet 318 of front wall 306, and with corner post 310 in the same manner described above. The respective upper ends 344 of each of these side panels 312*g*, 312*h*, and 312*i* are releasably fastened with respective lower ends 346 of each of the side panels 312*d*, 312*e*, and 312*f*, also in the same, partially overlapping manner described above. The respective lower ends 346 of each of these side panels 312*g*, 312*h*, and 312*i* also can be releasably fastened with bottom wall 302 in the same manner as described above in connection with FIG. 18 or via welding.

As described above, in coupling side panels 312*a*-312*i* to one another, each side panel 312 can partially overlap with (i.e., is partially in front of or behind) at least two sides or ends of another side panel 312. As a result, certain side panels 312 may be closer to the exterior of container 300 than other side panels 312, and certain side panels 312 may be closer to the interior of container 300 than other side panels 312. Many different configurations for releasably fastening a plurality of side panels 312 together are possible and within the scope of the present disclosure. In some embodiments, the side panels 312 in a side wall assembly 304 can alternate between being in front or behind other side panels 312 in a pattern analogous to that of the black and white squares on a checkerboard.

One example of this is best seen in FIG. 30, wherein a portion of the second surface 338 of panel 312*a* is in front of (e.g., more exterior of) and disposed against portions of the first surfaces 340 of panels 312*b* and 312*d*. Likewise, a portion of the second surface 338 of panel 312*e* is in front of (e.g., more exterior of) and disposed against portions of the first surfaces 340 of panels 312*b*, 312*d*, 312*f*, and 312*h*. A portion of the second surface 338 of panel 312*c* is in front of (e.g., more exterior of) and disposed against portions of the first surfaces 340 of panels 312*b* and 312*f*. A portion of the second surface 338 of panel 312*g* is in front of (e.g., more exterior of) and disposed against portions of the first surfaces 340 of panels 312*d* and 312*h*. And a portion of the second surface 338 of panel 312*i* is in front of (e.g., more exterior of) and disposed against portions of the first surfaces 340 of panels 312*f* and 312*h*. In all cases, apertures defined in the ends of various side panels 312 are brought into alignment with corresponding apertures defined in the ends of the side panels 312 that they engage. Thus, in this embodiment, panels 312*a*, 312*c*, 312*e*, 312*g*, and 312*i* are in front of panels 312*b*, 312*d*, 312*f*, and 312*h* when viewed from the exterior of container 300.

Of course, in another embodiment, the opposite arrangement could be provided. In yet other embodiments, when viewed from the exterior of container 300, panel 312*a* could be disposed in front of panels 312*b* and 312*d*; panels 312*b* and 312*d* could be disposed in front of panels 312*c*, 312*e*, and 312*g*; panels 312*c*, 312*e*, and 312*g* could be disposed in front of panels 312*f* and 312*h*; and panels 312*f* and 312*h* could be disposed in front of panel 312*i*, which could be the innermost panel. This arrangement could of course be done with any of side panels 312*c*, 312*g*, and/or 312*i* as the outermost panel. In other arrangements, panel 312*e* could be either the outermost panel or the innermost panel. All such other arrangements are contemplated.

Moreover, in some embodiments in which a side wall assembly 304 includes a plurality of side panels 312, some or all of the various side panels 312 can be non-overlapping. In other words, and for example, edges of some or all of the side panels 312 could engage the edges of adjacent side panels 312 without being in front of or behind such edges. In this case, vertical and/or horizontal posts and/or cross-members (e.g., analogous to corner post 310 and support members 324) could be provided on the interior or exterior side of side wall assembly 304 such that they are disposed over the interface between two or more side panel 312 edges. These posts and/or cross members can be provided with apertures that are aligned with corresponding apertures defined in the various ends of side panels 312 once disposed in the proper position for assembly. Thereby, suitable fasteners could be used to releasably secure these components together. In other embodiments, adjacent edges of side panels 312 could define inwardly- or outwardly-facing flanges (e.g., analogous to flanges 256, described above) that allow the various side panels 312 to be releasably fastened together.

Next, FIG. 32 illustrates an embodiment of floor assembly 302. In various embodiments, floor assembly 302 is modular and comprises a plurality of panel subassemblies 354 that are coupled (e.g., releasably fastened) together. One example panel subassembly 354 is illustrated in the exploded view of FIG. 33. Depending on the size or interior volume of container 300, its floor subassembly 302 may comprise one or more panel subassemblies 354. In this example, four (4) panel subassemblies 354 are provided.

Referring to FIG. 33, a panel subassembly 354 in this embodiment comprises a metal sheet 356 of suitable strength for waste storage and disposal applications and that is generally rectangular in shape. It may be formed, for example, of 7 or 12 gauge steel or of another suitable material. Flanges 358 depend perpendicularly from at least two opposite edges of sheet 356 and may be formed, for example, via a bending process. A first side 360 of sheet 356 may face an interior of container 300 in use and an opposite second side 362 of sheet 356 may face the exterior (e.g., bottom) of container 300 in use.

A plurality of support members 364 are coupled with second side 362 of sheet 356 and extend between flanges 358. In this embodiment, three (3) such support members 364 are provided, though any suitable number can be provided in other embodiments. Each support member 364 can be formed of a suitable metal material and comprise a length of channel or square tubing. In various embodiments, support members 364 can be coupled with sheet 356 by any suitable method, such as by releasable fasteners or via welding.

In order that multiple panel subassemblies 354 can be coupled together to form floor assembly 302, at least one support member 364 defines a plurality of apertures along a face thereof that extends perpendicularly to sheet 356. Whether one or multiple support members 364 defines apertures therein can depend, for example, on the location of a particular panel subassembly 354 in the floor assembly 302. Referring also to FIG. 32, for instance, the leftmost and rightmost panel subassemblies 354 may each have one support member 364 defining apertures, whereas the two interior panel subassemblies 354 may have two support members 364 defining apertures.

To couple first and second panel subassemblies 354 together in one example, the panel subassemblies 354 first are brought together so that the faces of support members 364 defining apertures are adjacent to one another. The apertures in the support members 364 are defined such that, when the sheet 356 of the first panel subassembly 354 is generally parallel with the sheet 356 of the second panel subassembly 354 and the flanges 358 of the first panel subassembly 354 are generally parallel to the flanges 358 of the second panel subassembly 354, the apertures in the respective support members are in alignment. Then, suitable fasteners may be used to releasably fasten the first and second panel subassemblies 354 together. A similar approach may be used to add additional panel subassemblies 354, as needed or desired, to a given floor assembly 302.

Turning now to FIGS. 34-35, a still further embodiment of the present invention is shown. In this embodiment, a container 400 is a rectangular open-topped roll-of container comprising a floor assembly 402, two side wall assemblies 404 in facing opposition, and a front wall 406. Container 400 also can comprise either a rear wall or a door, although neither is shown in this embodiment. Container 400 in this embodiment is analogous in certain respects to container 300, described above. For instance, floor assembly 402 in this embodiment is identical to floor assembly 302.

In this embodiment of container 400, each side wall assembly 404 comprises a corner post 410, a plurality of side panels 412, and a top rail 414. Again, the number of side panels 412 depends on the size of each side panel, the size or volume and shape of container 400, the orientation of side panels 412, and the particular side of the container 400 at issue. Where, as shown, a side wall assembly 404 is provided on the long sides of an open-topped roll-off container, in one embodiment three (3) such panels may be provided. In this embodiment, side panels 412 are oriented horizontally (e.g., with a longitudinal axis of each side panel 412 being parallel with an axis defined along the long dimension of container 400), rather than vertically or at another angle. Of course, in other embodiments and for other sides of a container, different numbers and configurations of panels 412 may be used. Again, in the embodiment of container 400, a plurality of side panels 412 also could be used for any of front wall 406, a door, and/or floor assembly 402.

Top rails 414 are generally analogous to top rails 314 above, except in this embodiment top rails 414 comprise a length of tubing that is triangular in cross-section. Corner posts 410 are coupled with the lateral edges of several side panels 412, for example via mechanical fasteners or via welding, either alone or in combination with the use of locating features such as those described herein. Corner posts 410 also extend between top rails 414 and floor assembly 402. Corner posts 410 can be coupled with floor assembly 402 via any suitable method, including mechanical fasteners as described herein or via welding, either alone or in combination with locating features such as those described above in connection with FIG. 18. Again, in a mechanically-fastened application, various embodiments may also include a mounting bracket and/or securing gusset.

Front wall 406 in this embodiment is generally analogous to front wall 306 described above, except in this embodiment its top rail 416 is similar to top rail 414, and the lateral edges of its metal sheet 418 define a shape that corresponds to the profile of the panels 412 that form each side wall assembly 404. For instance, here, the lateral edges of metal sheet 418 define a plurality of peaks 420 so that the edges of sheet 418 correspond to the profile of each side wall assembly 404, which may assist with mechanical and/or welded mating. As with metal sheet 318 above, metal sheet 418 also could define one or more flanges that project perpendicularly toward the interior volume of container 400, and such flanges could be shaped to define a surface that corresponds to an interior surface of the connected side panels 412 of side wall assembly 404. Similarly, corner posts 410 in this embodiment are generally analogous to corner posts 310, described above, except that the distal edges of the flanges of corner posts 410 define a shape that corresponds to the shape of the panels 412 hat form the side wall assembly 404. Thus, here, corner posts 410 have flanges defining a plurality of peaks 422 so that the flanges mate flush with a side wall assembly 404 once assembled. As discussed above in connection with corner posts 310, though, other variations are contemplated and within the scope of the present invention.

As shown in FIGS. 34-35, side panels 412 in this embodiment comprise a metal sheet of suitable strength for refuse disposal applications (e.g., 7 or 12 gauge steel), though other suitable materials may be used. Side panels 412 can be generally rectangular in shape, though each defines a cross section that is shaped like an arrow or "V", with the point of the arrow or V facing toward the exterior of the container 400. Side panels 412 can be formed from a single unitary sheet, for instance by a bending process, though this is not required in all embodiments.

In general, and as with side panels 312 described above, each side panel 412 can define a plurality of apertures at various positions around its perimeter that, during assembly, can be aligned with correspondingly-defined apertures in other side panel(s) 412, corner posts 410, and/or top rail 414 (not shown, but analogous to those described above in connection with container 100) to releasably fasten these various components to one another. As those of skill in the art will appreciate, the number and placement of apertures in a given side panel 412 will depend on its location within a side wall assembly 404, and each side panel 412 may not have the same number and/or configuration of apertures as the other side panels 412. Thus, apertures in side panel 412 are not shown in this embodiment, but they can be analogous to the apertures 152 of side panels 114 shown above, and the apertures in corner posts 410 and/or top rail 414 can be analogous to apertures 153, described above. In various embodiments, suitable fasteners include, but are not limited to, bolts screws, nails, and other mechanical fasteners such as those described in connection with container 100 above, and of course the type, number, and grade of fasteners used will vary, as needed or desired, in various embodiments.

In various embodiments, side panels 412 can be coupled to the top rail 414, to each other, to front wall 406, to corner post 410, and to floor assembly 402 in any of the manners described herein. Thus, in certain embodiments, mechanical fasteners are used, either alone or in combination with locating features. In various embodiments, welding can be used in the alternative or in addition, as can mounting brackets and/or securing gussets.

Based on the foregoing, it will be appreciated that embodiments of the invention provide improved containers and modular wall assemblies therefor. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A container, comprising:

a first side wall, a second side wall opposite the first side wall, a front wall coupled with the first and second side walls, a rear wall opposite the front wall and coupled with at least one of the first and second side walls, and a bottom wall coupled with at least the first and second side walls and the front wall;

the first side wall, second side wall, front wall, rear wall, and bottom wall together defining an open-topped interior volume of at least ten (10) cubic yards;

at least one of the first side wall, second side wall, front wall, and rear wall comprising:

a top rail; and a plurality of side panels;

the bottom wall comprising a floor assembly, the floor assembly comprising at least two panel subassemblies releasably fastened together, each panel subassembly comprising a metal sheet having a first side facing the interior volume and a second side opposite the first side, wherein a plurality of support members are coupled with the second side of the metal sheet;

and wherein the plurality of support members extend between flanges depending from opposite sides of the metal sheet, wherein the flanges are formed from bending a portion of the metal sheet.

2. The container of claim 1, wherein a first panel subassembly of the at least two panel subassemblies is disposed with respect to a second panel subassembly of the at least two panel subassemblies such that one of the plurality of support members of the first panel subassembly is in engagement with one of the plurality of support members of the second panel subassembly.

3. The container of claim 2, wherein the support member of the first panel subassembly defines a first set of apertures that are aligned with a second set of apertures defined in the support member of the second panel subassembly, and wherein a plurality of mechanical fasteners extend through the first and second sets of apertures to fasten the first panel subassembly and the second panel subassembly together.

4. The container of claim 1, wherein the at least two panel subassemblies comprises four panel subassemblies.

5. The container of claim 1, wherein each of the support members comprises a length of channel or square tubing.

6. The container of claim 1, wherein the plurality of support members includes three or more support members, and two support members of the three or more support members are located at opposite lateral edges of the sheet.

7. A container, comprising:

first, second, and third side walls and an open end;

a bottom wall coupled with the first, second, and third side walls;

a door pivotably coupled to the container opposite the third side wall and movable between a first position at which the door is spaced apart from the at least one open end and a second position at which the door closes the at least one open end;

wherein the container defines an open-topped interior volume of at least ten (10) cubic yards;

wherein at least one of the first, second, and third side walls comprises a plurality of rectangular side panels; and wherein the bottom wall comprises a floor subassembly, the floor subassembly comprising first, second, and third panel subassemblies each comprising a sheet supported by one or more support members, wherein the first panel subassembly comprises a first support member in facing opposition to a second support member of the second panel subassembly, wherein the second panel subassembly comprises a third support member in facing opposition to a fourth support member of the third panel subassembly, wherein the first, second, third, and fourth support members extend perpendicularly to the first and second side walls, wherein the sheets of the first, second, and third panel subassemblies each define a pair of laterally opposed depending flanges formed by bending portions of the respective sheets, and wherein the first, second, third, and fourth support members each extend between the pair of laterally opposed depending flanges.

8. The container of claim 7, wherein the first, second, and third panel subassemblies are releasably fastened together by mechanical fasteners.

9. The container of claim 7, wherein the one or more support members includes three or more support members, and two support members of the three or more support members are located at opposite lateral edges of the sheet.

10. A container, comprising:

vertical side walls and a horizontal bottom wall coupled with the vertical side walls;

the vertical side walls and horizontal bottom wall together defining an open-topped interior volume of at least ten (10) cubic yards;

at least one of the vertical side walls comprising:

a plurality of side panels; and a top rail fastened together with the upper ends of at least one of the plurality of side panels;

the bottom wall comprising a floor subassembly, the floor subassembly comprising a plurality of panel subassemblies, each of the plurality of panel subassemblies comprising:

a metal sheet having a first side facing the interior volume and an opposite second side; and at least one support member coupled with the second side of the metal sheet; wherein the plurality of panel subassemblies are brought together so that faces of support members are adjacent to one another and the adjacent support members are coupled together via mechanical fasteners.

11. The container of claim 10, wherein each of the plurality of panel subassemblies comprises a pair of depending flanges, wherein the depending flanges are formed from bending portions of the respective metal sheet.

12. The container of claim 10, wherein a first vertical side wall of the vertical side walls comprises a unitary metal sheet.

13. The container of claim 10, wherein each panel subassembly comprises a plurality of support members formed from a length of channel or tubing.

14. The container of claim 10, wherein the plurality of panel subassemblies includes three or more panel subassemblies.

15. The container of claim 10, wherein the sheet of each of the plurality of panel subassemblies extends between two laterally opposed vertical sidewalls.

16. The container of claim 10, wherein the at least one support member of each respective panel subassembly defines a face extending perpendicular to the sheet of each respective panel subassembly.

17. The container of claim 16, wherein the face of the at least one support member of each panel subassembly is in engagement with the face of the at least one support member on another panel subassembly.

18. The container of claim 10, wherein each of the plurality of panel subassemblies comprises at least two support members, the at least two support members located at opposite lateral edges of the sheet.

19. The container of claim 10, wherein the at least one support member includes the three or more support members, and two support members of the three or more support members are located at opposite lateral edges of the sheet.

* * * * *